US011571910B2

(12) United States Patent
Pfeffer

(10) Patent No.: US 11,571,910 B2
(45) Date of Patent: Feb. 7, 2023

(54) PRINTER

(71) Applicant: VIDEOJET TECHNOLOGIES INC., Wood Dale, IL (US)

(72) Inventor: Gary Pfeffer, Nottingham (GB)

( * ) Notice: Subject to any disclaimer, the term of this patent is extended or adjusted under 35 U.S.C. 154(b) by 77 days.

(21) Appl. No.: 17/050,709

(22) PCT Filed: Mar. 19, 2020

(86) PCT No.: PCT/EP2020/057669

§ 371 (c)(1),
(2) Date: Oct. 26, 2020

(87) PCT Pub. No.: WO2020/200823

PCT Pub. Date: Oct. 8, 2020

(65) Prior Publication Data

US 2021/0229459 A1 Jul. 29, 2021

(30) Foreign Application Priority Data

Mar. 29, 2019 (GB) ..... 1904440

(51) Int. Cl.
*B41J 2/325* (2006.01)
*B41J 2/305* (2006.01)

(52) U.S. Cl.
CPC ..... *B41J 2/325* (2013.01); *B41J 2/305* (2013.01); *B41J 2202/31* (2013.01)

(58) Field of Classification Search
CPC . H04N 1/02409; H04N 1/02463; B41J 2/325; B41J 2/305; B41J 2202/31; B41J 2/35; B41J 25/304; B41J 25/312; B41J 25/316
See application file for complete search history.

(56) References Cited

FOREIGN PATENT DOCUMENTS

| | | | |
|---|---|---|---|
| GB | 2519371 | A | 4/2015 |
| WO | 2013025746 | A1 | 2/2013 |
| WO | 2017216573 | A2 | 12/2017 |

OTHER PUBLICATIONS

PCT/EP2020/057669 International Search Report and Written Opinion, dated Jun. 29, 2020, 9 pages.

*Primary Examiner* — Kristal Feggins
(74) *Attorney, Agent, or Firm* — Wolter Van Dyke Davis, PLLC; Robert L. Wolter

(57) ABSTRACT

A printer comprising a printhead configured to selectively cause a mark to be created on a substrate, a stepper motor having an output shaft coupled to the printhead, the stepper motor being arranged to vary the position of the printhead, a sensor configured to generate a signal indicative of an angular position of the output shaft of the stepper motor, and a controller arranged to generate control signals for the stepper motor. Said control signals being at least partially based upon an output of said sensor and at least partially based upon a target position. Said control signals for the stepper motor are arranged to cause a magnetic field to be generated by windings of the stepper motor. A field angle being defined between an angular position of the output shaft of the stepper motor, and an orientation of the generated magnetic field. Said control signals comprise a first control signal configured to cause said field angle to have a predetermined value, and a second control signal configured to cause said magnetic field to have a predetermined magnitude, and said controller is configured to vary said first and second control signals based upon said target position and said output of said sensor.

20 Claims, 6 Drawing Sheets

PRINTER

The present invention relates to a printer. More particularly, but not exclusively, the invention relates to apparatus and methods for controlling the pressure exerted by a printhead on a printing surface against which printing is to take place.

Thermal transfer printers use an ink carrying ribbon. In a printing operation, ink carried on the ribbon is transferred to a substrate which is to be printed. To effect the transfer of ink, a print head is brought into contact with the ribbon, and the ribbon is brought into contact with the substrate. The print head contains printing elements which, when heated, whilst in contact with the ribbon, cause ink to be transferred from the ribbon and onto the substrate. Ink will be transferred from regions of the ribbon which are adjacent to printing elements which are heated. An image can be printed on a substrate by selectively heating printing elements which correspond to regions of the image which require ink to be transferred, and not heating printing elements which correspond to regions of the image which require no ink to be transferred.

In some thermal transfer printers, printing is effected by use of a stationary printhead, past which ribbon and substrate are moved. This operation may be referred to as "continuous" printing. Here the print speed is defined by the speed of movement of the substrate and ribbon past the stationary printhead. However, in an alternative printing technique (so-called "intermittent" printing), the substrate and ribbon are held stationary and the printhead is moved relative to the stationary substrate and ribbon. Here the print speed is defined by the speed of movement of the printhead relative to the stationary ribbon and substrate.

Direct thermal printers also use a thermal printhead to generate marks on a thermally sensitive substrate. A print head is brought into direct contact with the substrate. When printing elements of the print head are heated, whilst in contact with the substrate, marks are formed on the regions of the substrate which are adjacent to printing elements which are heated.

It is known that various factors affect print quality. For example it is important that the printhead is properly positioned relative to the printing surface and also important that the printhead applies an appropriate pressure to the printing surface and the ribbon and substrate which is sandwiched between the printhead and the printing surface.

Movement of the printhead relative to the printing surface (i.e. towards and away from the printing surface) is, in some prior art printers, effected by one or more motors coupled to the printhead, and configured to press the printhead into contact with the printing surface and any substrate and ribbon located between the printhead and the printing surface. Such an arrangement is effective but has associated disadvantages.

In particular, high torque levels are required, and significant levels of heat can be generated in motor windings.

It is an object of some embodiments of the present invention to provide a novel printer which obviates or mitigates at least some of the disadvantages set out above.

According to a first aspect of the invention there is provided a printer comprising: a printhead configured to selectively cause a mark to be created on a substrate, a stepper motor having an output shaft coupled to the printhead, the stepper motor being arranged to vary the position of the printhead. The printer further comprises a sensor configured to generate a signal indicative of an angular position of the output shaft of the stepper motor and a controller arranged to generate control signals for the stepper motor. Said control signals are at least partially based upon an output of said sensor. Said control signals are at least partially based upon a target position. The control signals for the stepper motor are arranged to cause a magnetic field to be generated by windings of the stepper motor. A field angle is defined between an angular position of the output shaft of the stepper motor, and an orientation of the generated magnetic field. Said control signals comprise a first control signal configured to cause said field angle to have a predetermined value. Said control signals comprise a second control signal configured to cause said magnetic field to have a predetermined magnitude. The controller is configured to vary said first and second control signals based upon said target position and said output of said sensor.

The control of a stepper motor using positional feedback allows the commutation of currents supplied to the motor to be controlled so as to cause the magnetic field generated by the energised windings of the motor to have an orientation which causes a predetermined torque to be generated. Current feedback may also be used so as to allow the controller to cause that a desired current to flow in the motor windings. Thus, there are two parameters which can be controlled (field orientation and current magnitude) in order to achieve a directed motor output characteristic (e.g. generated torque).

By controlling (and varying) both of the orientation and magnitude of the magnitude of the magnetic field generated by a stepper motor, it is possible achieve precise and adaptable control of the motor. This enables the motor output torque to be controlled both accurately and efficiently so as to be a required value (e.g. as required in order to achieve a desired output position). For example, where high precision is needed, the field angle may be the primary controlled variable, whereas where high torque is needed, the field magnitude may be the primary controlled variable.

By use of an encoder associated with the output shaft of the stepper motor, it is possible to provide accurate positional information regarding the actual rotor position, thereby allowing the field angle to be accurately controlled. Control of the field angle in this way allows a maximum output torque to be generated by the motor for a given current level, while also reducing the risk that a stepper motor will stall. In this way, it is possible to provide a smaller stepper motor (i.e. one having a smaller maximum torque capacity), and a correspondingly smaller power supply for a given torque requirement. That is, rather than having to provide an excess torque capacity, so as to prevent against stall conditions (and the associated loss of motor control), the motor can be controlled in a closed-loop field controlled manner to generate a maximum torque at all times, without any risk that the motor will stall. The signal indicative of the angular position of the motor output shaft can thus be used to update the control signals supplied to the motor, so as to cause the magnetic field to rotate, thereby maintaining the predetermined (and optimal) field angle.

The control signals for the stepper motor may comprise control signals supplied to windings of the stepper motor.

The stepper motor may be arranged to vary the position of the printhead relative to a printing surface against which printing is carried out.

The first control signal may be generated based upon the signal indicative of an angular position of the output shaft of the stepper motor so as to cause the field angle to have said predetermined value.

That is, the magnetic field may be controlled as to maintain a predetermined angle between the field orientation and the actual rotor positon. Thus, the actual rotor positon may be used to both determine how much torque may be generated by the motor (e.g. based on a positon error), and to orient the field so as to cause the determined torque to be generated.

The controller may be configured to vary said first and second control signals based upon a position control signal. The position control signal may be generated based upon said target position and said output of said sensor.

The position control signal may be derived from a desired (i.e. target) position of the output shaft of the stepper motor, and an actual position of the output shaft of the stepper motor. The position control signal may be generated by a PID controller.

The controller may be configured to vary said first and second control signals based upon a predetermined relationship with position control signal.

The controller may be configured to vary said first control signal based upon a first predetermined relationship with said position control signal.

The controller may be configured to vary said first control signal according to the first predetermined relationship when said position control signal satisfies a first predetermined condition.

For example, if the position control signal is below a threshold value, the first control signal (i.e. field angle control signal) may be varied based upon position control signal until the first control signal reaches a maximum at the threshold value. Controlling the field angle in this way provides a high degree of sensitivity when there is a low position error, and, correspondingly a low torque requirement.

The first control signal (i.e. field angle control signal) may be varied linearly based upon position control signal until the first control signal reaches a maximum at the threshold value.

The controller may be configured to vary said first control signal according to the first predetermined relationship, and may control said second control signal to have a fixed value when said position control signal satisfies the first predetermined condition.

The fixed value of the second control signal may correspond to a predetermined magnitude of the magnetic field.

By varying the field angle in this way while fixing the current scaling value a high degree of sensitivity can be provided when there is a low position error, and, correspondingly a low torque requirement.

The controller may be configured to vary said second control signal based upon a second predetermined relationship with said position control signal.

The controller may be configured to vary said second control signal according to the second predetermined relationship when said position control signal satisfies a second predetermined condition.

For example, if the position control signal is above a threshold value, the second control signal (i.e. the current scaling control signal) may be varied based upon the position control signal. Current scaling control provides the ability to generate high torque when a large position error is present, and where a correspondingly large corrective torque is required. However, by using current scaling to perform this type of control (rather than torque angle control) it is possible to minimise (or at least reduce) the power consumed by the motor, and increase the motor's efficiency.

The controller may be configured to vary said second control signal according to the second predetermined relationship. The controller may control said first control signal to have a fixed value when said position control signal satisfies the second predetermined condition.

The fixed value of the first control signal may correspond to a predetermined field angle.

When applying high torque, the field angle may be set to a maximum value (90 degrees electrical) so as to ensure that no excess current is used.

By varying (and fixing) different control signals in different regions, high efficiency can be provided when needed (i.e. to deliver high torque), while high resolution control can be used to provides a high degree of sensitivity when there is a low position error, and, correspondingly a low torque requirement. In this way, excess currents can be minimised, thereby limiting the heat generated within the motor windings.

The first relationship may define a first control resolution and the second relationship may define a second control resolution. The first control resolution may be higher than the second control resolution. The controller may be referred to as a dual-resolution position controller.

For example, when the first condition is satisfied, and relatively low current levels are needed, high control resolution may be provided. On the other hand, when the second condition is satisfied, and relatively high current levels are needed, a lower control resolution may be provided. Once the position error has been reduced by the application of a large corrective torque, finer control may again be used.

The predetermined value of the field angle may be based upon a motor output characteristic. The motor output characteristic may comprise a desired motor output characteristic.

The motor output characteristic may comprise a maximum torque output. For example, a stepper motor may generate a maximum torque for a given magnitude of winding current when the field angle has a predetermined value (e.g. 90 electrical degrees).

The generated magnetic field may have a predetermined angular orientation with respect to a housing of said stepper motor. The predetermined angular orientation with respect to the housing of said stepper motor may be varied in order to maintain the value of the field angle at said predetermined value. That is, the motor housing may be physically stationary (with respect to the body of the printer), with the generated magnetic field at any point in time having a predetermined angular orientation with respect to the housing. However, the predetermined angular orientation may be controlled as required (for example based upon rotation of the rotor) so as to maintain the value of the field angle at said predetermined value.

The control signals for the stepper motor may be generated so as to cause a predetermined torque to be generated by the stepper motor. Generating said control signals for the stepper motor so as to cause a predetermined torque to be generated by the stepper motor may comprise generating control signals for the stepper motor so as to cause a predetermined magnitude of current to flow in windings of the stepper motor. By causing the predetermined magnitude of current to flow in windings of the stepper motor the magnetic field is caused to have the predetermined magnitude.

Causing said predetermined magnitude of current to flow in windings of the stepper motor may comprise providing a pulse width modulated signal to said windings. Causing said predetermined magnitude of current may comprise controlling a duty cycle of the pulse width modulated signal provided to said windings. Causing said predetermined magnitude of current may comprise controlling an average current flowing in said windings.

The controller may comprise a position controller arranged to receive said target position and said signal indicative of an angular position of the output shaft of the stepper motor. The controller may generate said position control signal. Said position control signal may be indicative of a predetermined torque to be generated by the stepper motor.

The position control signal may be referred to as a torque demand signal.

The position controller may be arranged to generate a position error signal based on said target position and said output of said signal indicative of an angular position of the output shaft of the stepper motor. The position controller may generate said position control signal based upon said position error signal.

The position error signal may be based on a difference between the target position and the angular position of the output shaft of the stepper motor.

The controller may be configured to generate said target position based on a desired printhead motion profile.

The desired printhead motion profile may be intended to cause the printhead to move in a direction perpendicular to the printing surface and/or parallel to the printing surface.

The controller may be configured to control the stepper motor to cause the printhead to maintain a position in which it may be spaced apart from the printing surface by a predetermined separation, this may be based upon said target position.

The controller may be configured to control the stepper motor so as to cause the printhead to move from a position in which it is pressed against the printing surface to a position spaced apart from the printing surface, this may be based upon said target position.

The printhead may be rotatable about a pivot. The stepper motor may be arranged to cause rotation of the printhead about the pivot to vary the position of the printhead relative to the printing surface.

The printer may further comprise a printhead assembly. The printhead assembly may comprise a first arm and a second arm. The first arm may be coupled to the stepper motor, and the printhead may be disposed on the second arm. The stepper motor may be arranged to cause movement of the first arm, and thereby may cause rotation of the second arm about the pivot, and may cause the position of the printhead relative to the printing surface to vary.

The stepper motor may be coupled to the first arm via a flexible linkage. The linkage may be a printhead rotation belt. The printhead rotation belt may pass around a roller driven by the output shaft of the stepper motor such that rotation of the output shaft of the stepper motor causes movement of the printhead rotation belt, movement of the printhead rotation belt causing the rotation of the printhead about the pivot.

The printer may further comprise a printhead drive mechanism for transporting the printhead along a track which may extend generally parallel to the printing surface.

The controller may be configured to control the stepper motor to cause the printhead to maintain a position in which it is spaced apart from the printing surface by a predetermined separation during transport of the printhead along the track, which may extend generally parallel to the printing surface, between printing strokes.

The controller may be configured to control the motor to cause a predetermined pressure to be exerted by the printhead on the printing surface during transport of the printhead along the track extending generally parallel to the printing surface during a printing stroke.

The stepper motor may be a first motor, and the printhead drive mechanism may comprise a second stepper motor.

The printhead drive mechanism may further comprise a printhead drive belt operably connected to the printhead and a second motor for controlling movement of the printhead drive belt; wherein movement of the printhead drive belt causes the printhead to be transported along the track extending generally parallel to the printing surface.

The printhead drive belt may pass around a roller driven by the second motor such that rotation of an output shaft of the second motor causes movement of the printhead drive belt, movement of the printhead drive belt causing the printhead to be transported along the track extending generally parallel to the printing surface.

The controller may be configured to control said first and second motors in a coordinated manner to control the position of the printhead in directions which may be parallel and/or perpendicular to the printing surface.

The printer may further comprise a second sensor which may be configured to generate a signal indicative of an angular position of the output shaft of the second motor. The printer may further comprise a controller which may be arranged to generate second control signals for the second motor. Said second control signals may be at least partially based upon an output of said second sensor and may be at least partially based upon a second target position Said second control signals for the stepper motor may be arranged to cause a second magnetic field to be generated by windings of the second motor. A second field angle may be defined between an angular position of the output shaft of the second motor, and an orientation of the generated second magnetic field. Said second control signals may comprise a first second control signal which may be configured to cause said second field angle to have a second predetermined value. A further second control signal may be configured to cause said second magnetic field to have a second predetermined magnitude. Said controller may be configured to vary said first and further second control signals based upon said second target position and said output of said second sensor.

The first and second motors may be controlled in a similar manner in order to provide accurate and efficient control of the position of each motor, thereby providing accurate control of the position of the printhead in directions parallel and perpendicular to the printing surface.

The printer may be a thermal printer and the printhead may be configured to be selectively energised so as to generate heat which causes the mark to be created on the substrate.

The printer may be a thermal transfer printer and the printhead may be configured to be selectively energised so as cause ink to be transferred from an ink carrying ribbon to the substrate so as to cause the mark to be created on the substrate.

The printer may be a thermal transfer printer which may further comprise first and second spool supports each may be configured to support a spool of ribbon The printer may further comprise a ribbon drive which may be configured to cause movement of ribbon from the first spool support to the second spool support.

The printhead may be configured to be selectively energised so as to generate heat which may cause the mark to be created on a thermally sensitive substrate.

According to a second aspect of the invention there is provided a thermal transfer printer comprising: first and second spool supports each being configured to support a spool of ink carrying ribbon. The thermal transfer printer further comprises a ribbon drive configured to cause movement of ribbon from the first spool support to the second spool support, and a printhead configured to be selectively energised so as cause ink to be transferred from the ribbon to the substrate so as to cause a mark to be created on the substrate. The ribbon drive comprises a stepper motor having an output shaft operably associated with one of said spool supports, the stepper motor being arranged to cause said one of the spool supports to rotate to cause said movement of ribbon from the first spool support to the second spool support. The ribbon drive further comprises a sensor configured to generate a signal indicative of an angular position of the output shaft of the stepper motor, and a controller arranged to generate control signals for the stepper motor. Said control signals are at least partially based upon an output of said sensor and at least partially based upon a target position. Said control signals for the stepper motor are arranged to cause a magnetic field to be generated by windings of the stepper motor, a field angle being defined between an angular position of the output shaft of the stepper motor, and an orientation of the generated magnetic field. Said control signals comprise a first control signal configured to cause said field angle to have a predetermined value, and a second control signal configured to cause said magnetic field to have a predetermined magnitude. Said controller is configured to vary said first and second control signals based upon said target position and said output of said sensor.

The control of a stepper motor using positional feedback allows the commutation of currents supplied to the motor to be controlled so as to cause the magnetic field generated by the energised windings of the motor to have an orientation which causes a predetermined torque to be generated. Current feedback may also be used so as to allow the controller to cause that a desired current to flow in the motor windings. Thus, there are two parameters which can be controlled (field orientation and current magnitude) in order to achieve a directed motor output characteristic (e.g. generated torque).

By controlling (and varying) both of the orientation and magnitude of the magnetic field generated by a stepper motor, it is possible achieve precise and adaptable control of the motor. This enables the motor output torque to be controlled both accurately and efficiently so as to be a required value (e.g. as required in order to achieve a desired output position). For example, where high precision is needed, the field angle may be the primary controlled variable, whereas where high torque is needed, the field magnitude may be the primary controlled variable.

By controlling both of the orientation and magnitude of the magnetic field generated by a stepper motor, the position of the motor can be controlled accurately without generating excess heat in the motor windings.

The controller may be arranged to control the stepper motor so as to cause the output shaft of the motor to rotate to a predetermined angular orientation, which may be referred to as a target positon. The motor may be controlled so as to cause the ribbon extending between the spools to follow a predetermined motion profile.

The controller may comprise a position controller arranged to receive said target position and said signal indicative of an angular position of the output shaft of the stepper motor. The controller may generate said position control signal. Said position control signal may be indicative of a predetermined torque to be generated by the stepper motor. The position control signal may be referred to as a torque demand signal.

The position controller may be arranged to generate a position error signal based on said target position and said output of said signal indicative of an angular position of the output shaft of the stepper motor. The position controller may generate said position control signal based upon said position error signal.

The position error signal may be based on a difference between the target position and the angular position of the output shaft of the stepper motor. The controller may be configured to generate said target position based on a desired ribbon motion profile.

The first spool support may be a supply spool support. The second spool support may be a takeup spool support.

The output shaft of the stepper motor may be operably associated with said takeup spool support. The controller may be arranged to control the stepper motor so as to cause said predetermined torque to be exerted by the takeup spool support on a takeup spool mounted thereon.

The controller may be arranged to control the angular position of an output shaft of the stepper motor so as to control the angular position of the takeup spool support. The controller may be arranged to control the angular position of an output shaft of the stepper motor so as to control the angular speed of the takeup spool support.

The stepper motor may be a first stepper motor. The ribbon drive may further comprise a second stepper motor. An output shaft of the second stepper motor may be operably associated with said supply spool support.

The ribbon drive may further comprise a second sensor configured to generate a signal indicative of an angular position of the output shaft of the second stepper motor, the controller may be arranged to generate control signals for the second stepper motor.

Said control signals for the second stepper motor may be at least partially based upon an output of said second sensor and at least partially based upon a second target position. Said control signals for the stepper motor may be arranged to cause a magnetic field to be generated by windings of the second stepper motor, a field angle being defined between an angular position of the output shaft of the second stepper motor, and an orientation of the generated magnetic field. Said control signals may comprise a further first control signal configured to cause said field angle to have a predetermined value, and a further second control signal configured to cause said magnetic field to have a predetermined magnitude. Said controller may be configured to vary said first and second control signals based upon said target position and said output of said second sensor.

The controller may be configured to control the first stepper motor and the second stepper motor in a position controlled way. The controller may be configured to control the first stepper motor and the second stepper motor so as to transport ribbon according to a predetermined motion profile. By controlling both motors in this way, the rate of movement and the tension of ribbon can be controlled accurately.

The controller may be arranged to control the angular position of an output shaft of the second stepper motor so as to control the angular position of the supply spool support. The controller may be arranged to control the angular position of an output shaft of the second stepper motor so as to control the angular speed of the supply spool support.

Between printing operations, both motors may be controlled in a position (or speed) controlled manner, so as to accelerate or decelerate the ribbon in a controlled manner, or to rewind ribbon from the takeup spool to the supply spool. During such operations, maintaining a predetermined the tension in the ribbon may be less important than during printing operations.

According to a third aspect of the invention there is provided a method of operating a printer according to either of the first or second aspects of the invention.

Any feature described in the context of one aspect of the invention can be applied to other aspects of the invention. For example, features described in the context of the first aspect of the invention can be applied to the second aspect of the invention and vice versa. For example, the dual-resolution control scheme described in the context of a printhead position controller in the first aspect of the invention can be applied to the control of ribbon motion by the second aspect of the invention. Similarly, features described in the context of either of the first or second aspects of the invention may be applied to the method of the third aspect of the invention.

Embodiments of the invention will now be described, by way of example, with reference to the accompanying drawings, in which.

Figure 1:
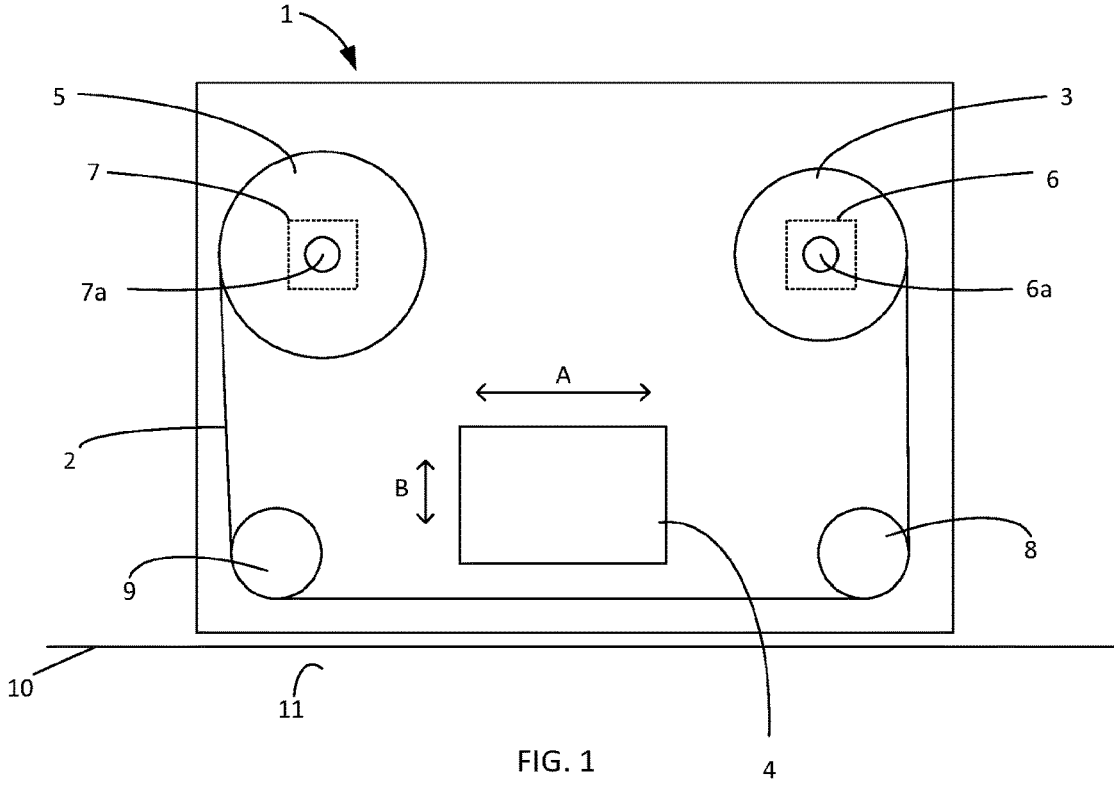
FIG. 1 is a schematic illustration of a printer in accordance with the present invention.

Referring to FIG. 1, there is illustrated a thermal transfer printer 1 in which ink carrying ribbon 2 is provided on a ribbon supply spool 3, passes a printhead assembly 4 and is taken up by a ribbon take-up spool 5. The ribbon supply spool 3 is driven by a stepper motor 6 while the ribbon take-up spool is driven by a stepper motor 7. In the illustrated embodiment the ribbon supply spool 3 is mounted on an output shaft 6*a* of its stepper motor 6 while the ribbon take-up spool 5 is mounted on an output shaft 7*a* of its stepper motor 7. The stepper motors 6, 7 may be arranged so as to operate in push-pull mode whereby the stepper motor 6 rotates the ribbon supply spool 3 to pay out ribbon while the stepper motor 7 rotates the ribbon take-up spool 5 so as to take up ribbon. In such an arrangement, tension in the ribbon may be determined by control of the motors. Such an arrangement for transferring tape between spools of a thermal transfer printer is described in our earlier U.S. Pat. No. 7,150,572, the contents of which are incorporated herein by reference.

In other embodiments the ribbon may be transported from the ribbon supply spool 3 to the ribbon take up spool 5 past the printhead assembly 4 in other ways. For example only the ribbon take up spool 5 may be driven by a motor while the ribbon supply spool 3 is arranged so as to provide resistance to ribbon motion, thereby causing tension in the ribbon. That is, the motor 6 driving the ribbon supply spool 5 may not be required in some embodiments. Resistance to ribbon movement may be provided by a slipping clutch arrangement on the supply spool. In some embodiments the motors driving the ribbon supply spool 5 and the ribbon take up spool 7 may be motors other than stepper motors. For example the motors driving the ribbon supply spool 5 and the ribbon take up spool 7 may be direct current (DC) motors. In general the motors driving the ribbon supply spool 5 and/or the ribbon take up spool 7 may be motors which are commonly referred to as torque controlled torque controlled motors (e.g. DC motors) or motors which are commonly referred to as position controlled motors (e.g. stepper motors, or DC servo motors).

Ribbon paid out by the ribbon supply spool 3 passes a guide roller 8 before passing the printhead assembly 4, and a further guide roller 9 and subsequently being taken up by the ribbon take up spool 5.

The printhead assembly 4 comprises a printhead (not shown) which presses the ribbon 2, and a substrate 10 against a printing surface 11 to effect printing. The printhead is a thermal transfer printhead comprising a plurality of printing elements, each arranged to remove a pixel of ink from the ribbon 2 and to deposit the removed pixel of ink on the substrate 10.

The printhead assembly 4 is moveable in a direction generally parallel to the direction of travel of the ribbon 2 and the substrate 10 past the printhead assembly 4, as shown by an arrow A. Further, at least a portion of the printhead assembly 4 is moveable towards and away from the substrate 10, so as to cause the ribbon 2 (when passing the printhead) to move into and out of contact with the substrate 10, as shown by arrow B.

Figure 2:
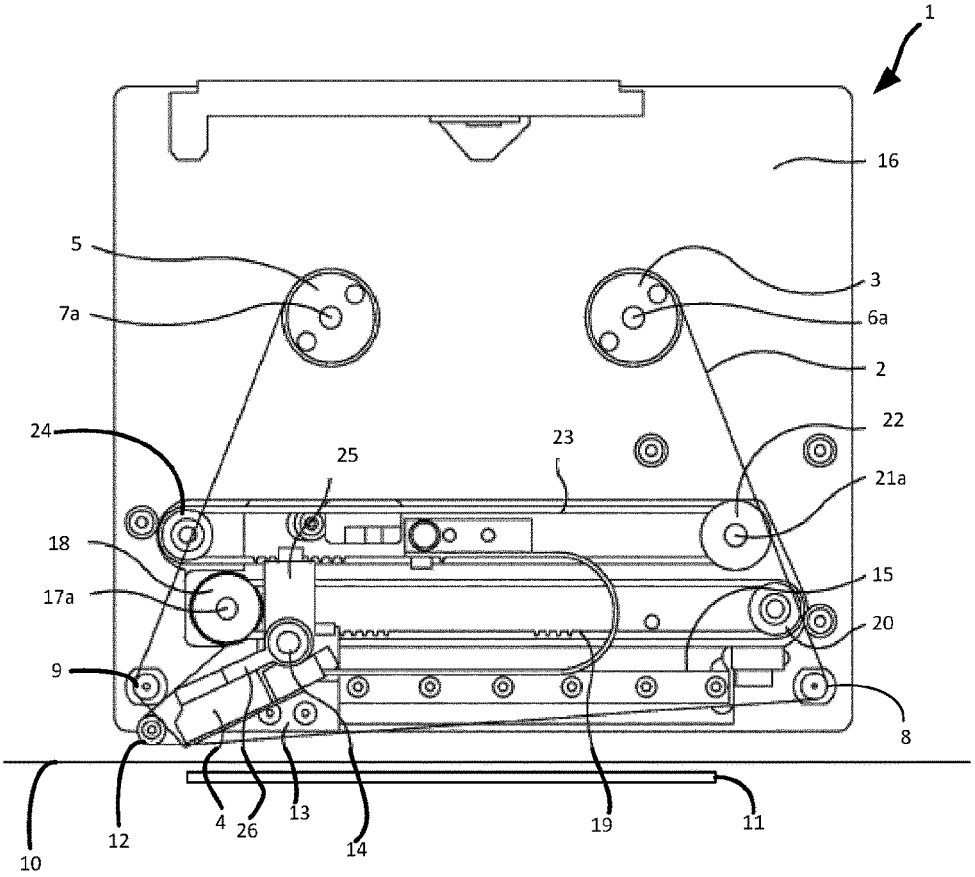
FIG. 2 is an illustration showing the printer of FIG. 1 in further detail.
Figure 3:
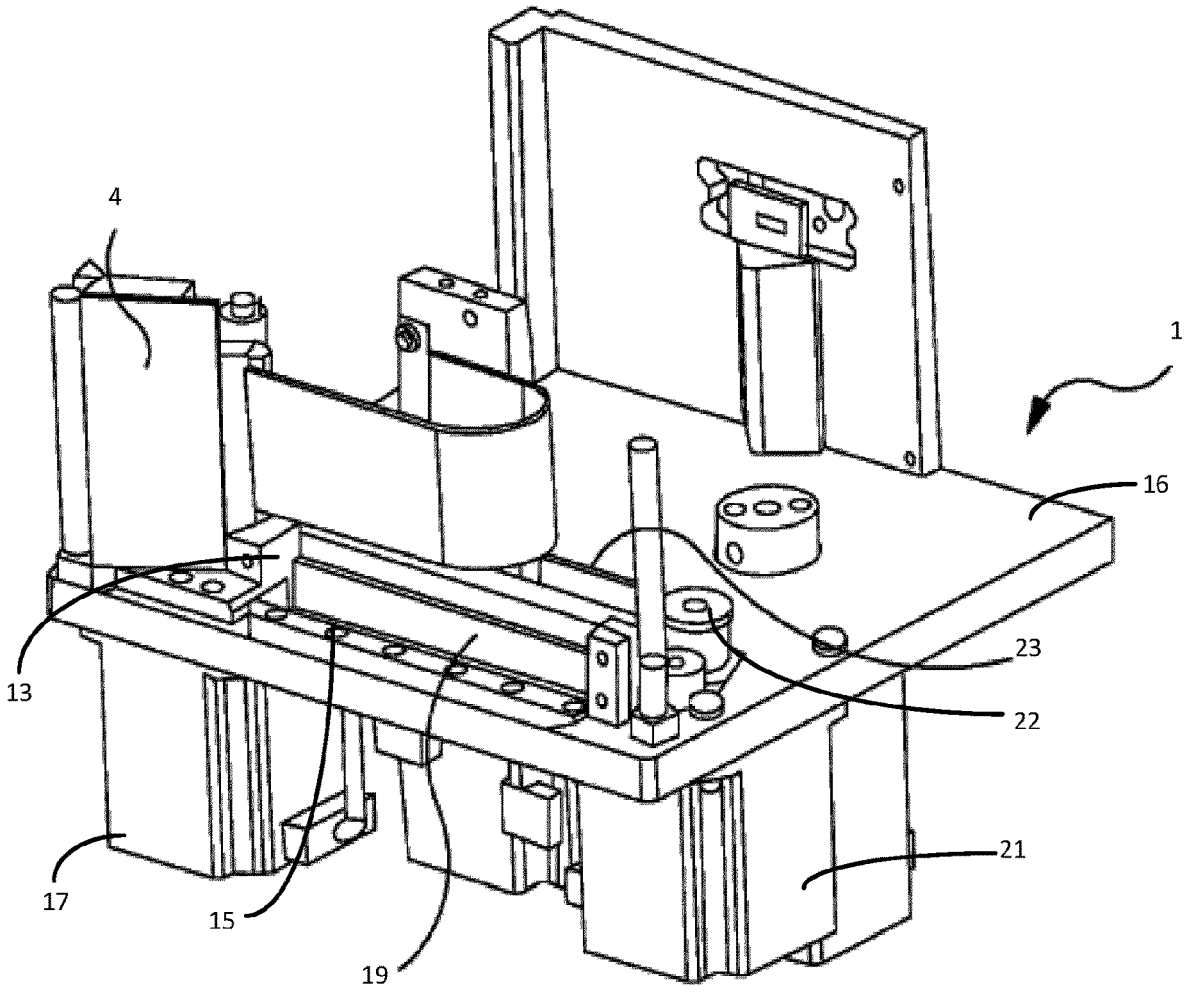
FIG. 3 is a perspective illustration showing the printer of FIG. 1 in further detail.

Referring now to FIGS. 2 and 3, the printer 1 is described in more detail. The printhead assembly 4 further comprises a guide roller 12, around which the ribbon 2 passes between the roller 9, and the printhead. The printhead assembly 4 is pivotally mounted to a printhead carriage 13 for rotation about a pivot 14 thereby allowing the printhead to be moved towards or away from the printing surface 11. The printhead carriage 13 is displaceable along a linear track 15, which is fixed in position relative to a base plate 16 of the printer 1.

The position of the printhead carriage 13 in the direction of ribbon movement (and hence position of the printhead assembly 4) is controlled by a carriage motor 17 (see FIG. 3). The carriage motor 17 is located behind the base plate 16 and drives a pulley wheel 18 that is mounted on an output shaft 17*a* of the carriage motor 17. The pulley wheel 18 in turn drives a printhead drive belt 19 extending around a further pulley wheel 20. The printhead carriage 13 is secured to the printhead drive belt 19. Thus rotation of the pulley wheel 18 in the clockwise direction drives printhead carriage 13 and hence the printhead assembly 4 to the left in FIG. 2 whereas rotation of the pulley wheel 18 in the counter-clockwise direction in FIG. 2 drives the printhead assembly 4 to the right in FIG. 2.

The movement of the printhead towards and away from the printing surface 11 (and hence the pressure of the printhead against the ribbon 2, the substrate 10, and the printing surface 11) is controlled by a motor 21. The motor 21 is also located behind the base plate 16 (see FIG. 3) and drives a pulley wheel 22 that is mounted on an output shaft of the motor 21. The pulley wheel 22 in turn drives a printhead rotation belt 23 extending around a further pulley wheel 24. The printhead assembly 4 comprises a first arm 25, and a second arm 26, which are arranged to pivot about the pivot 14. The first arm 25 is connected to the printhead rotation belt 23, such that when the printhead rotation belt 23 moves the first arm 25 is also caused to move. The printhead is attached to the second arm 26. Assuming that the pivot 14 remains stationary (i.e. that the printhead carriage 13 does not move), it will be appreciated that movement of the printhead rotation belt 23, causes movement of the first arm 25, and a corresponding movement of the second arm 26 about the pivot 14, and hence the printhead. Thus rotation of the pulley wheel 22 in the clockwise direction drives the first arm 25 in to the left in FIG. 2, causing the second arm 26 to move in a generally downward direction, and the printhead assembly 4 to move towards the printing surface 11. On the other hand, rotation of the pulley wheel 22 in the counter-clockwise direction in FIG. 2 causes the printhead assembly 4 to move away from the printing surface 11.

The belts 19, 23 may be considered to be a form of flexible linkage. However, the term flexible linkage is not intended to imply that the belts behave elastically. That is, the belts 19, 23 are relatively inelastic in a direction generally parallel to the direction of travel of the ribbon 2 and the substrate 10 past the printhead assembly 4 (i.e. the direction which extends between the pulley wheel 22 and the further pulley wheel 24). It will be appreciated, of course, that the belts 19, 23 will flex in a direction perpendicular to the direction of travel of the ribbon 2 and the substrate 10 past the printhead assembly 4, so as to allow the belts 19, 23 to move around the pulleys 18, 20, 22, 24. Further, the printhead rotation belt 23 will flex in a direction perpendicular to the direction of travel of the ribbon 2 and the substrate 10 past the printhead assembly 4, so as to allow for the arc of movement of the first 25 arm about the pivot 14. However, in general, it will be understood that the relative inelasticity ensures that any rotation of the pulley wheel 22 caused by the motor 21 is substantially transmitted to, and causes movement of, the first arm 25, and hence the printhead. The belts 19, 23 may, for example, be polyurethane timing belts with steel reinforcement. For example, the belts 19, 23 may be AT3 GEN III Synchroflex Timing Belts manufactured by BRECOflex CO., L.L.C., New Jersey, United States.

The arc of movement of the printhead with respect to the pivot 14 is determined by the location of the printhead relative to the pivot 14. The extent of movement of the printhead is determined by the relative lengths of the first and second arms 25, 26, and the distance moved by the printhead rotation belt 23. Thus, by controlling the motor 21 to cause the motor shaft (and hence pulley wheel 22) to move through a predetermined angular distance, the printhead can be moved by a corresponding predetermined distance towards or away from the printing surface 11.

It will further be appreciated that a force applied to the first arm 25 by the printhead rotation belt 23 will be transmitted to the second arm 26 and the printhead. Thus, if movement of the printhead is opposed by it coming into contact with a surface (such as, for example, the printing surface 11), then the force exerted by the printhead on the printing surface 11 will be determined by the force exerted on the first arm 25 by the printhead rotation belt 23—albeit with necessary adjustment for the geometry of the first and second arms 25, 26. Further, the force exerted on the first arm 25 by the printhead rotation belt 23 is in turn determined by the torque applied to the printhead rotation belt 23 by the motor 21 (via pulley wheel 22).

Thus, by controlling the motor 21 to output a predetermined torque, a corresponding predetermined force (and corresponding pressure) can be established between the printhead and the printing surface 11. That is, the motor 21 can be controlled to move the printhead towards and away from the printing surface 11, and thus to determine the pressure which the printhead applies to the printing surface 11. The control of the applied pressure is important as it is a factor which affects the quality of printing.

The description above assumes that the pivot 14 is stationary as the printhead is moved towards and away from the printing surface 11. Such an arrangement may, for example, be used to effect continuous printing. However, in some printing modes, such as, for example, intermittent printing, it is required for the printhead to move in the direction of substrate movement during a printing operation. Such movement is effected by moving the carriage 13 along the linear track 15 under the control of the carriage motor 17, as described above.

However, it will be appreciated that any movement of the printhead carriage 13, without a corresponding movement of the printhead rotation belt 23 will cause the first and second arms 25, 26 of the printhead assembly 4 to rotate about the pivot 14, moving the printhead towards or away from the printing surface 11. Thus, to ensure a stable printhead pressure and position during printhead movement, it is necessary to control the motors 17, 21 so as to drive the printhead drive and printhead rotation belts 19, 23 in a coordinated manner.

The movement of the printhead towards and away from the printing surface when the position of the pivot 14 is also moving is carried out in a similar manner to the situation described above where the position of the pivot 14 is fixed. However, control of motor 21, and thus control of the movement of the printhead rotation belt 23, is carried out relative to the position of the printhead drive belt 19, rather than to any fixed datum on the base plate 16.

For example, in order to maintain a predetermined separation between the printhead and the printing surface 11 during movement of the printhead carriage 13 along the linear track 15, the printhead rotation belt 23 should be controlled to move the same amount as the printhead drive belt 19. On the other hand, to maintain a predetermined pressure between the printhead and the printing surface 11 during movement of the printhead carriage 13 along the linear track 15, care should be taken to ensure that the printhead rotation belt 23 is controlled to move as the printhead drive belt 19 moves, while still providing a force to the first arm 25 which is sufficient to generate the predetermined printhead pressure.

Such control can be achieved, regardless of the position of the printhead rotation belt 23 with respect to the printhead drive belt 19, if the motor 21 is controlled to output a predetermined torque. This results in a predetermined pressure (which corresponds to the predetermined torque) being established between the printhead and the printing surface 11. That is, if the motor 21 is operated as a torque-controlled motor, the output shaft of the motor 21 (and hence the pulley 22 and printhead rotation belt 23) will be rotated so as to maintain the motor output torque at the predetermined level, regardless of the position of the printhead carriage 13 on the linear track 15, or even during movement of the printhead carriage 13. In this way, printhead pressure can be controlled with reference to a single control parameter of the motor 21, regardless of the printhead carriage position or movement state.

In some embodiments the motors 17, 21 are stepper motors. The stepper motors may each be associated with a rotary encoder which provides information relating to the rotary position of the motor shaft. Such information enables the windings of the stepper motor to be driven in a closed-loop manner, so as to be controlled in either a torque controlled or position controlled manner, as described in more detail below.

Figure 4:
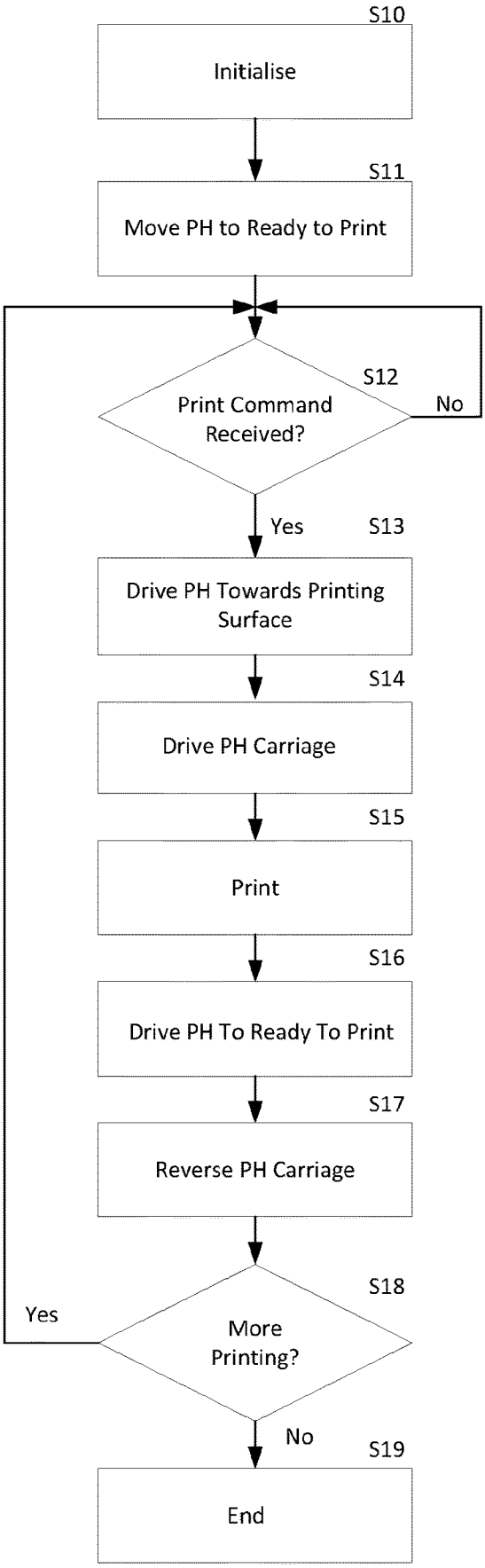
FIG. 4 is a flowchart showing control of the position of the printhead relative to a printing surface during printing operations.

The operation of the printer 1 described above is now described in more detail with reference to FIG. 4. While each of the motors 17, 21 may primarily control one of the print head carriage and the print head 4 respectively, it will of course be appreciated that the print head carriage 13 and the print head itself are both influenced by control of each of the print head carriage motor 17 and the print head motor 21. It will of course be appreciated that when describing the control scheme with reference to the motor 21 in detail below, it will be appreciated that the same control scheme may be used to control the motor 17 (albeit with a different position demand input).

Processing, which may be controlled by a controller (not shown) begins at step S10, where initialisation actions are carried out. Initialisation actions may include identifying the current position of the print head assembly by use of a known datum position and the encoder 72, and moving the print head carriage 13 along the linear track 15 to a desired position. Initialisation actions may further include pivoting the print head about the pivot 14 until the printhead assembly 4 is in a position where it abuts a physical stop, and/or where it is in contact with the printing surface 11, allowing the position of the printhead relative to the printing surface 11 to be established.

Once initialisation is complete, processing passes to step S11, where the print head is moved in to a ready to print position, in which the print head will not be in contact with the printing surface. The ready to print position corresponds to a position which is a known distance away from the printing position. As such, once initialisation has been completed at step S10, the printhead can be moved to, and maintained in, a ready to print position under positional control of the motor 21, with motor 17 also being controlled in a position controlled manner to maintain the print carriage in a fixed positon at the start of a printing stroke.

Once in the ready to print position, processing passes to step S12, where the printer will wait until a 'print' command is received. While no 'print' command is received processing loops around step S12.

Once a print command is received by the controller processing passes to step S13. At step S13 the motor 21 may be operated in a torque controlled mode and will be energised to drive the printhead towards the printing surface 11. Once contact is made between the printhead and the printing surface 11, the printhead exerts a pressure on the printing surface 11.

While the printhead carriage 13 is stationary, a holding torque may be applied to the printhead carriage motor 17, the motor 17 being operated in a position controlled mode. This holding torque may act to prevent rotation of the printhead carriage motor 17 in response to a reaction force acting on the printhead 4 from the printing surface 11 when the printhead 4 makes contact with the printing surface 11. It will be understood that a component of the reaction force acting on the printhead 4 will act, via the belt 19, to urge the printhead carriage motor 17 to rotate.

For example, the carriage motor 17 may be controlled in a closed-loop position controlled manner. Thus, to maintain a substantially stationary carriage position, a current will be provided to the windings of the printhead carriage motor 17. As the reaction force acting on the printhead 4 from the printing surface 11 increases, the carriage 13 may be caused to move slightly from the controlled position, such that a torque is generated by the carriage motor 17 (the torque varying based upon the angular offset between the desired positon and the actual position). Thus, if the current provided to the windings of the printhead carriage motor 17 is too low, the motor may stall, and the carriage may move in an undesirable (and unpredictable) way, for example, by moving to one end of its travel.

Once the contact pressure has been stabilised processing passes to step S14. In use, a predetermined settling time (e.g. 15 ms) after contact is made between the printhead 4 and the printing surface 11 may be allowed to elapse before processing passes to step S14.

At step S14, where intermittent printing is to be carried out, the carriage motor 17 is energised in a position controlled mode so as to cause the printhead drive belt 19 to move, moving the printhead carriage 13 along the linear track 15, causing the printhead to move parallel to the printing surface 11. During step S14, the carriage motor 17 may be controlled to cause the printhead carriage to move along the linear track 15 according to a predetermined motion profile. The predetermined motion profile may comprise an acceleration phase, a constant speed phase and a deceleration phase. The predetermined motion profile may comprise data indicative of a target speed for the carriage motor 17 at a plurality of points in time during each of these phases. The carriage motor 17 may be controlled in a closed loop position controlled manner (as described in more detail below) during this movement.

It will also be appreciated that such movement of the printhead carriage 13 will also cause the printhead assembly 4 to be moved. During this process, the motor 21 will typically be operated in a torque controlled mode, so as to cause the printhead to exert a predetermined pressure on the printing surface 11. The predetermined pressure with which the printhead 4 is caused to press against the printing surface 11 may correspond to an optimum printing pressure, and may be controlled by appropriate control of the current supplied to the windings of the printhead motor 21. In particular, the motor may be operated in a closed-loop field controlled manner in order to generate a predetermined torque.

Once the required movement speed of the printhead carriage 13 has been established, processing passes to step S15, where printing is carried out. The printhead is energised as it passes along the printing surface 11, transferring ink to the substrate 10 as required. It will be appreciated that it is desirable to provide a stable printing force for as large a proportion of a printing cycle as possible, so as to maximise the time available for printing (for example, by minimising time required for printhead force stabilisation). Of course, printing operations may be carried out during periods of constant speed motion of the printhead carriage 13, and also during acceleration and/or deceleration of the printhead carriage 13.

If continuous printing is to be carried out instead of intermittent printing step S14 can be omitted, and processing can pass directly from step S13 to S15.

Once printing is complete, processing passes to step S16 where the motor 21 is again operated in a position controlled mode. At step S16, the printhead may be commanded to move to the ready to print position. This causes the motor 21 to be energised in the reverse direction, causing the printhead assembly 14 to be moved away from the printing surface 11. The motor 21 may be controlled to cause the printhead to move from a position in which it is in contact with the printing surface 11 away from the printing surface 11 according to a predetermined motion profile. The predetermined motion profile may comprise data indicative of a target speed for the motor 21 during said movement of the printhead away from the printing surface 11.

Once the printhead assembly is retracted to the ready-to-print position, processing passes to step S17, where the printhead carriage 13 is moved, by appropriate control of the carriage motor 17 (typically in a position controlled mode) to be ready for a subsequent printing operation. The printhead carriage 13 may be moved along the linear track 15 in the opposite direction to the direction of movement during a printing operation. During step S17, the carriage motor 17 may again be controlled to cause the printhead carriage to move along the linear track 15 according to a further predetermined motion profile similar to that described above with reference to step S14. Where continuous printing is carried out, step S17 may be omitted.

Processing then passes to step S18, where it is determined whether more printing is required. If more printing is required, processing returns to step S12. On the other hand, if no more printing is required, processing terminates at step S19.

Figure 5:
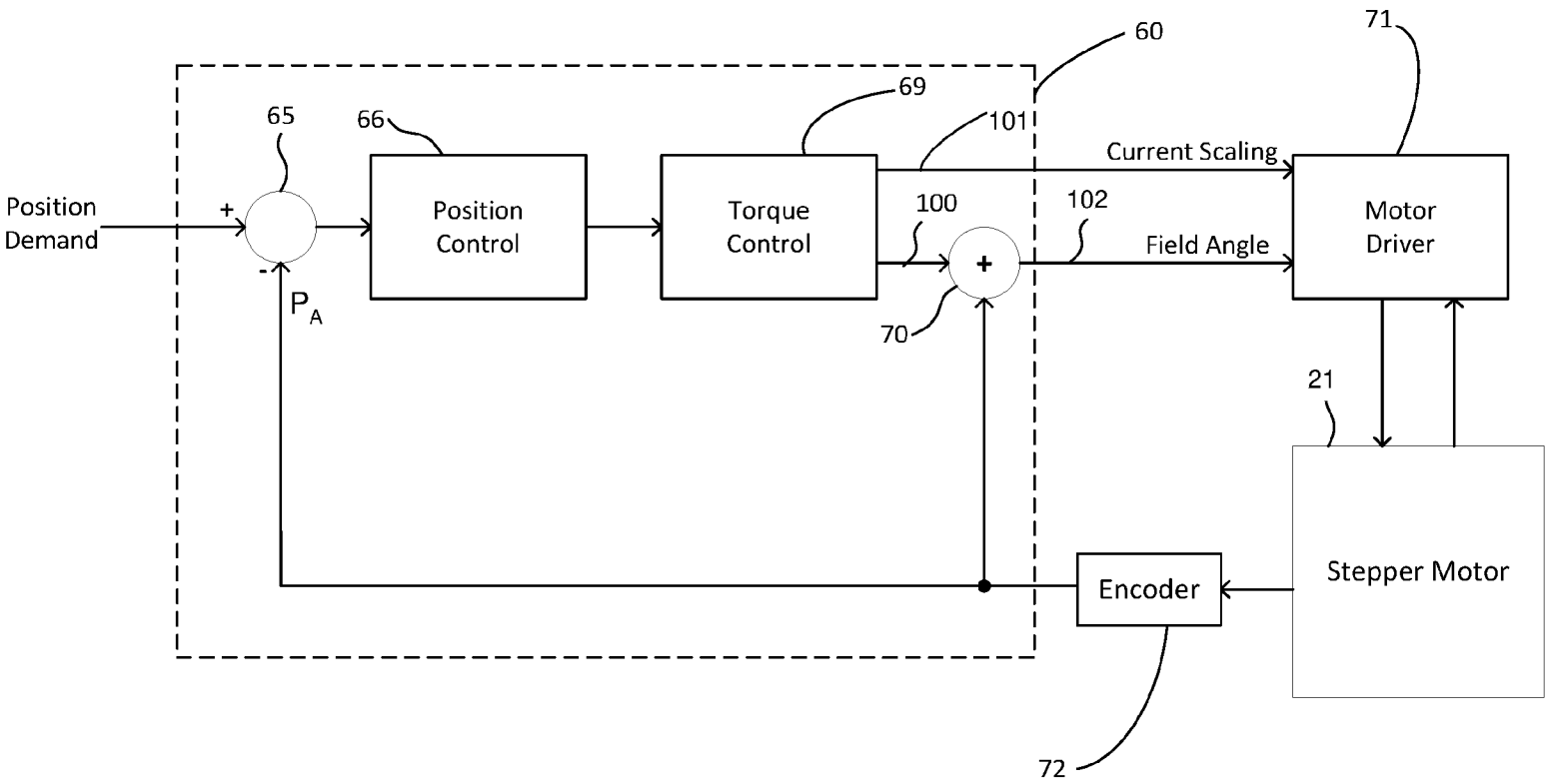
FIG. 5 is a schematic illustration of a controller arranged to control components of an alternative embodiment of the printer of FIG. 1.

FIG. 5 illustrates a motor controller 60 which is arranged to control the motor 21 during the printing operations described above. The motor controller 60 comprises a print head position adder 65, a position controller 66 and a torque controller 69.

The motor controller 60 generates control signals which are provided to a stepper motor driver 71. The stepper motor driver 71 in turn generates control signals which are provided to transistors which control the current flowing in the windings of the motor 21 (as described in more detail below with reference to FIG. 6).

An encoder 72 generates a signal indicative of the angular position of the output shaft of the motor 21. It will be appreciated that whereas a single output signal is shown in FIG. 5 as being generated by the encoder 72, the output may comprise a plurality of related signals. In particular, pulses generated by the encoder 72 may be processed to produce a signal indicative of angular position of the output shaft of the motor 21. The signal indicative of angular position of the output shaft of the motor 21 may be referred to as an absolute position signal $P_A$.

A further signal may be generated based upon the pulses generated by the encoder 72 which indicates an angular position of the output shaft of the motor 21 adjusted for changes caused by the carriage 13 (which may be used in a printhead position control mode). Such a signal may be referred to as a relative position signal. The relative position signal may have the property that, for a given printhead position (i.e. a given separation between the printhead and the printing surface), the output stays constant as the carriage 13 moves, even though the motor output shaft is rotating. A position error signal generated by the printhead position adder 65, which is provided to the printhead position controller 66, may be generated based upon this relative position signal, rather than the absolute position signal.

The motor controller 60 may be implemented in any convenient way. For example, the various blocks of the motor controller 60 may each be implemented as separate software sub-routines running on a general purpose processor, or as blocks implemented in an FPGA (or any combination thereof). It will be appreciated that the following description describes the functional interaction of these blocks, rather than the physical implementation. Further, whereas adders are described as adding or subtracting input signals to/from one another, it will be appreciated that the polarity of such operations may vary between different implementations (e.g. based upon the direction in which motor phases or encoders are connected).

The motor controller 60 is shown to receive an input that is indicative of the printhead position demand (which may be referred to as a target position). The printhead position demand signal is received by the printhead position adder 65. The position demand signal may be provided to the motor controller 60 by a motion control algorithm under the control of a printer controller, which may be configured to cause the printhead to follow a predetermined motion profile.

From this position demand signal the printhead position adder 65 subtracts the absolute printhead motor position signal $P_A$ received from the encoder 72. The output of the printhead position adder 65 is thus indicative of the difference between the demanded and actual position of the printhead motor 21. The output of the printhead position adder 65 is passed to the printhead position controller 66. The printhead position controller 66 may also receive as an input a position control gain (not shown). The printhead position controller 66 may be a PID controller which generates as an output a printhead motor position signal (or torque demand signal) which is passed to the torque controller 69. The gain provided to the position controller 66 may, for example, comprise just a proportional component, and thus the PID control loop may just use proportional control. The position controller may also be other types of controller such as a PI controller or a PD controller.

The motor controller 60 may also receive a number of other inputs (not shown) such as, for example, a speed demand signal, a carriage speed signal and a print force demand signal. These signals may be processed by various controllers (not shown) and added to the printhead motor position signal, forming a torque demand signal which is then passed to the torque controller 69. It will of course be appreciated that any or all of these other signals may be zero, such that the torque demand signal corresponds directly the printhead motor position signal described above.

The torque controller 69 generates a current scaling signal 101, which is passed to the stepper motor driver 71, and a field angle control signal 100. The field angle control signal 100 is passed to the phase angle adder 70, where it is summed with a printhead motor position signal received from the encoder 72. An output 102 of the phase angle adder 70 is passed to the stepper motor driver 71.

Figure 6:
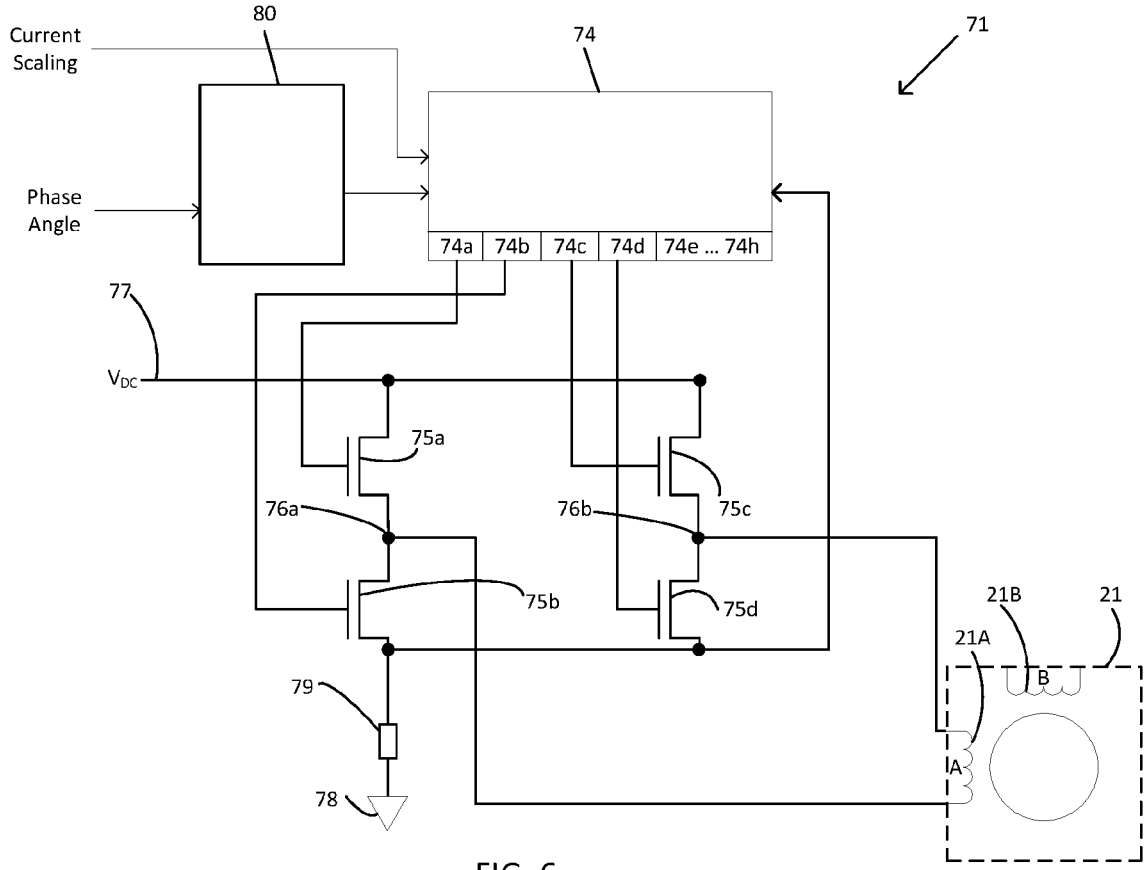
FIG. 6 is a schematic illustration of a part of the controller of FIG. 5.

FIG. 6 illustrates the stepper motor driver 71 which is arranged to drive the stepper motor 21. The stepper motor 21 is (in this embodiment) a two-phase bipolar stepper motor having two phases 21A, 21B, shown schematically at 90 degrees to one another. Each of the phases 21A, 21B may comprise multiple windings. The stepper motor driver 71 comprises a stepper motor controller 74, which receives as inputs motor phase current signals generated by a field vector generation block 80 and the current scaling signal 101 generated by the torque controller 69. The field vector generation block 80 receives as an input the output of the phase angle adder 70 (as described above with reference to FIG. 5).

The motor stepper driver 71 further comprises four power transistors 75*a* to 75*d* arranged in series pairs (75*a* and 75*b*, 75*c* and 75*d*), each pair having an intermediate node 76*a*, 76*b* between the two transistors of that pair. The two pairs of transistors are arranged in parallel between a DC power supply 77 and a ground connection 78. Each pair of transistors comprises an upper transistor 75*a*, 75*c* and a lower transistor 75*b*, 75*d* which are arranged to provide two parallel connections between the DC power supply 77 and the ground connection 78. As is common-place in PWM motor drives, free-wheel diodes may be associated with each of the transistors 75*a*-75*d*, allowing current to continue flowing in the windings when the transistors 75*a*-75*d* are switched off. It will be appreciated that there are many modes of operation of a full bridge current controller (e.g. 'fast', 'slow', and 'mixed' current decay modes) known in the art in which the transistors are switched in various sequences to achieve a desired motor current response under the control of a controller.

The intermediate nodes 76*a*, 76*b* are each connected to a respective end of the windings of the first phase 21A of the motor 21.

In operation each of the transistors 75*a* to 75*d* is controlled by a respective one of the output signals 74*a* to 74*d* so as to cause the first phase 21A to be energised in accordance with the desired winding current level. It will be appreciated that the first phase 21A can be energised in two directions and that it may comprise several windings, some of which may be arranged in opposing directions.

The current flowing through the windings of the first phase 21A returns through one of the lower transistors 75*b*, 75*d*, via a low value shunt resistor 79 to the ground connection 78. The use of a low value shunt resistor allows several amps of motor winding current to flow without causing significant losses in the resistor. The value of the shunt resistor determines the level of current which will be caused to flow in the motor windings for each value of the current scaling signal 101 specified to the stepper motor controller 74 by the torque controller 69. The low value shunt resistor 79 may, for example be, a resistor having a resistance of around 0.04 ohm. The voltage developed across the resistor 79 is proportional to the current flowing through the windings of the first phase 21A, according to Ohm's law. The voltages developed across the resistor 79 is monitored by the stepper motor controller 74, for example by being provided to an comparator with the controller 74 where it is compared with a desired current level. The stepper motor controller 74 may be configured to compare a voltage developed across the resistor 79 with different reference voltages based upon a sensitivity setting. Thus, for a given sensitivity setting, the choice of resistor 79 will determine the maximum current level ($I_{pk}$), and thus level of current which will be caused to flow in the motor windings for each value of the current scaling signal 101 specified to the stepper motor controller 74.

The second phase 21B is driven by a similar arrangement of transistors (not shown) to that described as driving the first phase 21A, controlled by output signals 74*e* to 74*h*.

As described above with reference to FIG. 5, the controller 60 is configured to control the stepper motor 21 based upon a signal which is indicative of the rotary position of the output shaft of the motor 21. The signal is generated by the encoder 72 which is associated with the motor 21 and which generates an output which accurately represents the angular position of the output shaft of motor 21. The angular position of the output shaft of motor 21 may be measured relative to the stator windings of the motor, or some other fixed position of a housing of the stepper motor. The encoder 72 may be arranged to generate 2048 output events (8192 quadrature events) during a full revolution of the output shaft of the motor 21. The encoder 72 may suitably be an AMT10 capacitive encoder manufactured by CUI Inc., Oregon, United States.

The stepper motor 21 may suitably be a bipolar two-phase stepper motor such as the 103H7822-1710 motor manufactured by Sanyo-Denki CO., LTD., Japan. This stepper motor has 200 full steps per revolution, each full step corresponding to an angular movement of the output shaft of the motor of 1.8 degrees.

The stepper motor controller 74 may be a controller such as a TMC262 manufactured by Trinamic Motion Control GmbH and Co. KG, Germany. It will be appreciated that in some embodiments the stepper motor controller 74 may be provided with step and direction control signals, and be arranged to internally determine the current magnitude and field angle values required to effect stepper motor movements as required. However, in some embodiments (as described in more detail below) the stepper motor controller 74 may be arranged to control the commutation and switching of transistors which are connected to the motor windings, so as to effect current magnitude and field angle values specified by the torque controller 69 and the field vector generation block 80. The field vector generation block 80 may, for example, be provided as a software routine running within a general purpose controller, or within FPGA logic (e.g. controller 60) and may thus be part of a separate controller to the stepper motor controller 74.

In such an arrangement the controller 60 is arranged to receive, as an input, an actual angular position of the stepper motor output shaft from the encoder 72. The field vector generation block 80 then generates electrical signals which are provided to the stepper motor controller 74 which in turn causes the windings of the stepper motor to be energised so as to cause the stator field to rotate to a position which will cause the rotor to move in the desired way.

In this way, the torque generated by the stepper motor 21 can be controlled and optimised. For example, by controlling the torque (or field) angle (that is, the angular offset between the stator field position and the rotor position) the torque can be maximised for a particular magnitude of current supplied to the motor windings. In particular, it is known that a stepper motor produces maximum torque when a field angle of 90 (electrical) degrees is used. Thus, the use of such a field angle allows the stepper motor to generate a maximum torque for a given winding current.

Moreover, the use of positional feedback based upon the output of the encoder 72 allows the motor winding currents to be modulated so as to produce a desired torque level at all times. That is, rather than controlling the stepper motor 21 to operate in an open-loop position controlled mode, the stepper motor 21 can be operated in a closed-loop manner, using positional feedback. With such a control arrangement, and by appropriate control of the current supplied to the windings of the stepper motor 21, the torque generated by the stepper motor, and hence the printhead pressure can be controlled to a predetermined value.

Of course, it will be appreciated that the use of a stepper motor also allows the use of conventional open-loop stepper motor control (which may be referred to as stepping mode) when beneficial. For example, such open-loop control may be used to move the printhead in free-space, or to maintain a predetermined free-space position of the printhead (e.g. when the printhead is maintained in the ready to print position prior to commencing a printing operation, or during printhead carriage movement between printing cycles).

Further, in some embodiments a stepper motor may be operated in a closed loop positon controlled manner (as opposed to a closed-loop torque controlled manner, or an open-loop position controlled manner). Such control may be effected by use of the position controller 66.

By providing accurate information relating to the angular position of the output shaft (and thus the rotor) of the stepper motor 21, it is possible to achieve many of the benefits conventionally associated with stepper motors (e.g. high torque output, low-cost, and high-speed operation) while also providing advantageous characteristics usually associated with DC motors (e.g. a well-known relationship between the current supplied to the motor and the torque output by the motor). Moreover, by providing accurate positional information, and controlling the stator field based upon this information, there is no risk that a stepper motor will stall if the load is greater than the maximum torque capacity. Rather than the motor stalling, the stator field will simply be controlled so as to rotate to an angle which allows the required torque to be provided.

In an embodiment the stepper motor 21 may be operated in each of the modes described above during a single printing cycle. For example, during printing operations, when the printhead 4 is in driven towards and maintained in contact with the printing surface 11 (e.g. during steps S13 to S15 described above with reference to FIG. 4), the printhead motor 21 may be operated in a closed-loop torque controlled manner, with the print force being primarily controlled by the print force controller 67.

Then, during movement of the printhead 4 away from the printing surface 11 to the ready-to-print position, the printhead motor 21 may be operated in a closed-loop position controlled manner (under the control of the position controller 66), so as to ensure that accurate positional control is maintained. Closed-loop position control may also be used to control the motor 21 during step S17, when the printhead is moved between printing strokes, with the target position being set based upon the position of the carriage 13, or the rotational position of the output shaft of the carriage motor 17. Such control allows movement of the two motors 17, 21 to be closely synchronised, even during rapid movements, so that the printhead position relative to the printing surface 11 is maintained during carriage return. During such operations, it will be appreciated that it is desirable to maintain a positional relationship between the printhead 4 and the printing surface 11, such that the vertical position of the printhead (in the orientation shown in FIG. 2) does not vary, ensuring that the printhead is in a known position, and can quickly move towards the printing surface once more to carry out a new printing operation when required.

Generally speaking, closed loop position control allows the motor 21 to be operated in an efficient manner, with the fastest possible operation being achieved for a given current level, with minimal torque ripple, and with a reduced risk of stalling.

Of course, it will be appreciated that in some embodiments alternative control schemes may be used. Moreover, the various control techniques described above may be combined as appropriate for each particular application.

The description of the motor control arrangements above with reference to FIGS. 5 and 6 primarily relate to the control of the printhead motor 21. However, it will be understood that a similar controller may also be provided for the carriage motor 17. Moreover, the carriage motor 17 may, in some embodiments, be operated in a closed loop position controlled manner at all times.

The way in which the torque generated by the stepper motors 17 and 21 will now be described in more detail. By controlling the current supplied to windings of the stepper motors 17, 21 based upon information relating to the angular position of the rotor, the orientation of the field generated by the motor is controlled. This type of control allows the stepper motor to be operated in a torque-controlled manner, so as to generate a predetermined output torque. Such a generated torque can be converted (via a suitable mechanical coupling) to a predetermined force (corresponding for a particular area to a predetermined pressure) which is to be exerted by the printhead on the printing surface during printing operations. Moreover, when in a position controlled mode, the predetermined output torque can be controlled so as to bring about a desired change in position (e.g. to minimise a position error between a demanded position and an actual position).

Figure 7:
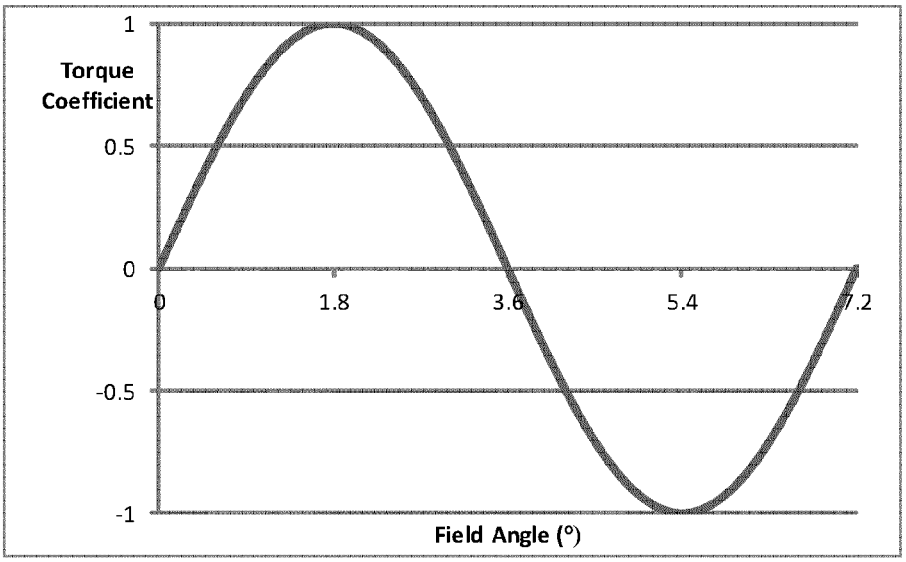
FIG. 7 is a graph showing the relationship between the field angle of control signals applied to a stepper motor and a coefficient of generated torque.

In more detail, as illustrated in FIG. 7, the torque generated by a stepper motor depends upon an angle formed between the magnetic field of the rotor and the magnetic field generated by the energised motor windings. In FIG. 7, the x-axis shows field angle, and the y-axis shows torque coefficient. The torque coefficient illustrated at each point indicates the torque that is generated as a proportion of the maximum available torque (for a given winding current) at a particular field angle. Where a stepper motor having a full step angle of 1.8 degrees is used (i.e. having 200 full steps per revolution), as in this example, an electrical angle of 90 degrees corresponds to a physical angle of 1.8 degrees. The generated torque is, therefore, at a maximum when a physical angle of 1.8 degrees is formed between the magnetic field vector and the rotor field position.

It is noted that where the angular position of the rotor field, and the direction of the stator field are discussed, what is meant is that there is a nominal position of the rotor and a nominal position of the stator field, and that the relative position between these two positions varies according to some relationship. The angular offset between the nominal position of the rotor and the nominal position of the stator field may be referred to as the field angle (or torque angle).

It will further be appreciated that in a stepper motor the rotor is generally configured such that there are many effectively identical angular positions in terms of magnetic and electrical performance, which may correspond to a plurality of different actual angular positions of the rotor shaft with respect to the stator (and therefore with respect to the motor housing). As such, depending on the initial position of a rotor, when a stepper motor is energised, the rotor may move to one of several (e.g. 50) distinct angular positions.

Similarly, the stator windings of the motor are typically arranged so as to have a number of windings which have different fixed angular positions. The magnetic field generated at any point in time can be represented by a vector which is based upon the relative field strengths generated by a number of windings (e.g. by each of two adjacent windings). For example, if two adjacent windings are energized to the same level, the field vector will be midway between the two windings. However, if one winding is fully energized and the adjacent winding is not energized, the field vector will be aligned with the energized winding. Again, it will be appreciated that there may be repeated windings within a motor and as such, when referring to a field vector position, it is meant to refer to the position of that field vector with reference to each set of windings.

The particular structure and control interface of a stepper motor may vary depending on the type of motor used, and will be well understood by the skilled person. An example of a particular arrangement is described in patent application WO 2017/216573, which is herein incorporated by reference. Particular reference is made to FIGS. 12 and 13 of that disclosure.

However, generally speaking, it will be understood that in some control arrangements, it is possible to control the magnitude of current and the field angle separately, with a control interface being provided to enable such control.

Moreover, it will be understood that an 'electrical angle' may be defined between a magnetic field orientation and a motor's rotor.

Given knowledge of the actual angular position of the rotor of the motor 21 (e.g. based upon the output of the rotary encoder 72), the currents caused to flow in the windings of the motor 21 can be controlled so as to achieve any desired stator field vector direction, and therefore cause any desired torque to be applied to the rotor. Moreover, as described above, the maximum torque generated by the motor (for a given winding current) can be achieved when there is a field angle of 90 degrees (electrical).

Therefore, to control the motor 21 so as to generate a maximum torque, it will be understood that maintaining a field angle of 90 electrical degrees is desirable. More generally speaking, the motor 21 can be controlled so as to generate a predetermined torque between zero and the maximum torque by appropriate control of the field angle.

In use, the magnitude and polarity of currents supplied to the motor windings may be updated so as to maintain the field angle at the predetermined value each time a signal indicating movement of the encoder 72 is received by the controller 60. Based upon typical geometry and operating conditions, the controller may receive over 75,000 encoder updates per second. For example, where an encoder generates 8192 quadrature events per revolution, and the pulley 22 has an outer diameter of 17.19 mm, an encoder event is generated for each 6.59 micrometre of linear movement at the circumference of the pulley 22. Where the pulley 22 is rotating so as to result in a linear speed of 500 mm/s (again, at the circumference of the pulley 22), 75846 quadrature events are generated each second. In some embodiments, the belt 19 may be driven by the pulley 22 at a linear speed of up to 800 mm/s. In further embodiments, the belt 23 may be driven by the pulley 22 at a linear speed of up to around 1000 mm/s, resulting in over 150,000 encoder updates being generated per second. Further, a current scaling factor (i.e. a value of the current scaling signal 101), which allows the magnitude of the field vector to be adjusted, may also be updated at frequent intervals, such as, for example, each millisecond.

Thus, the rotor is not caused to jump between native step positions (as would be the case in conventional stepping control). Rather, the rotor experiences a continually rotating magnetic field which causes the rotor to rotate in a smooth manner. Furthermore, the torque applied to the rotor does not experience the same level of torque ripple which is experienced during open loop step operation of a stepper motor. In particular, because of the continually updated energization field, the motor experiences a smooth torque, which is relatively insensitive of the exact alignment between the various physical features of the rotor and stator.

In use, the current supplied to the windings of the motor can be determined by the field vector generation block 80 by indexing into a pair of look up tables which represent the relative magnitude of the current supplied to each of the windings to generate a particular magnetic field vector. That is, for each magnetic field vector position indicated by the combination of a field angle control signal 100 and actual rotor position (as indicated by the encoder 72) there is a particular ratio of currents to be applied to the windings of the motor. Furthermore the magnitude of the current supplied to the windings of the motor can be modified (by adjustment of the current scaling signal provided to the stepper motor controller 74) so as to generate a different torque level.

It will be appreciated that any convenient technique may be used to convert the encoder position into an appropriate electrical angle, so as to enable the encoder position to be combined with the desired field angle. For example, an encoder output may be converted to an appropriate index into a lookup table without being converted into a physical angle.

A desired field lead angle as indicated by the field angle control signal is then added by phase angle adder 70 to generate a desired angle for a field vector which is to be applied in order to provide a demanded torque.

Thus, coil currents for each coil are generated by the stepper motor controller 74, as described above, based upon a current scaling signal 101 and a field angle control signal 100, which are generated by the torque controller 69.

In practice, rather than providing for continually variable current scaling, a stepper motor controller may provide for a predetermined number of equally spaced levels for the value of current scaling. For example, the TMC262 device may be arranged to provide 32 levels of current scaling, with the actual magnitude of current supplied to the motor windings being set by the electrical configuration of the device based upon the selected level. Thus, a maximum current capability may first be determined ($I_{pk}$), and then a scaling value between 1 and 32 selected, for example by the torque controller 69. The maximum current capability may be determined by characteristics of the power supply provided to the motor 21, and by configuration of the stepper motor controller 74. The current scaling value may be provided to the stepper motor controller 74 via a serial control interface, and used by the stepper motor controller 74, in combination with phase magnitude signals provided to the stepper motor controller 74 by the field vector generation block 80, to determine the level of current supplied to the motor windings.

Further, whereas the encoder position may be known to 1/8192 of a full revolution, the stepper motor controller may provide for position control based upon micro-step positons. For example, each full step (i.e. 1.8 degrees) may be divided into a plurality (e.g. 256) of equally spaced micro-steps.

Therefore, each switching sequence of 360 electrical degrees (which corresponds to 4 full-steps, or 7.2 physical degrees) may be sub-divided into 1024 micro-steps. A lookup table may be provided which includes current levels to be provided to the motor windings to achieve each of these 1024 micro-step levels. The lookup table may be provided within, or associated with, the stepper motor controller 74.

When operated in open-loop stepping (or micro-stepping) mode, the stepper motor controller 74 will advance an internal index into the lookup table so as to generate appropriate winding current levels based upon each step signal provided to the controller. However, when operating in a field-controlled manner (either in a torque controller mode, or in a closed-loop position controlled mode), the physical rotor position can be resolved to an equivalent micro-step positon (e.g. in the range 0 to 1023) so as to determine an appropriate ratio of winding current levels for each winding. Where the magnitude of winding currents is controlled by the field vector generation block 80 in this way, the lookup table may be stored in a memory location accessible by the field vector generation block 80.

An index into the lookup table may be required to be modified in a number of ways to ensure that an appropriate magnitude value is obtained. For example, it may be necessary to add or subtract a predetermined offset (e.g. 256), so as to achieve a required field angle (e.g. 90 electrical degrees) in order to generate a particular torque in a particular direction. Further, if such an adjustment results in the index being outside the range 0 to 1023, any over- or underflow can be dealt with by adding or subtracting 1024 as appropriate. Finally, the resulting index may be further manipulated so as to be mapped on to a value within a single quadrant (i.e. a value in the range 0 to 255). That is, a lookup table may be populated with current magnitude values in a single quadrant only (i.e. values 0 to 255, corresponding to 0 to 90 electrical degrees, or 0 to 1.8 physical degrees), and magnitude values for the remaining quadrants can be obtained by appropriate modification.

It will be appreciated that where the magnitude values follow a sinusoidal pattern, the magnitude values for the remaining quadrants (i.e. 90-180, 180-270, 270-360 degrees) can be readily calculated from the data provided for a single quadrant. Similarly, magnitude values following a cosine pattern (e.g. which may be required for a second electrical winding), may be readily calculated from the data provided for a sinusoidal pattern (or quadrant thereof) by appropriate manipulation.

Of course, alternative techniques may be used for generating an appropriate current level for each of the motor windings (e.g. by calculation). In some embodiments additional adjustments may be made to the appropriate current level for each of the motor windings. For example, a sine wave commutation pattern may be modified to compensate for non-linearities in motor performance.

In general, if a controlled torque is required to be generated by the motor, this can be achieved by setting the magnetic field angle to lead the rotor position by a predetermined angle. Then, as the rotor rotates in response to the application of the field, the applied field can be immediately updated using a feedback loop so as to ensure that the field is continually applied at an angle which leads the actual rotor position by the predetermined amount. This form of closed-loop control may be referred to a closed-loop field control, or field-oriented control. More generally, a desired motor output characteristic can be achieved by controlling the magnetic field to have a predetermined relationship with the rotor position.

Such closed-loop field control of a stepper motor effectively prevents any risk that the motor can stall. It will be appreciated that stalling of a conventionally controlled stepper motor (i.e. one which is controlled in an open loop position controlled manner) occurs when a resisting force to a desired movement of the rotor is greater than the maximum torque which can be applied by the motor for a given winding current, resulting in the field angle increasing past the maximum of 1.8 degrees, and slipping occurring between the actual rotor position and the desired position (which corresponds to the rotor position where the field angle is zero). Thereafter, it will be impossible to know the actual angular position of the motor and positional control may be lost. In particular, once a rotor has slipped from one pole alignment, it cannot be known if it has slipped through a single repeat of the magnetic repeat interval (e.g. 7.2 degrees, where each single step is 1.8 degrees), or a multiple thereof.

However, the use of the positional encoder 72 ensures that at all times the actual angular position of the rotor is known, and the field position vector can be controlled so as to have a predetermined angular relationship with the actual angular position of the rotor.

The use of a closed-loop field controlled rotor in this way ensures that the maximum torque output can be generated for a given motor for a given winding current. Moreover, it will also be appreciated that the avoidance of any risk of stall conditions allows a smaller motor to be used for a particular application than would otherwise be necessary. That is, whereas it is customary to oversize a motor (i.e. by providing a motor which is capable of supplying a torque greater than that required) such that stall conditions are not likely to occur given the severe negative consequences associated with stalling a position controlled motor, the provision of positional feedback allows a motor having a maximum torque capacity which is no more than is required by a particular situation to be used. Furthermore, the use of a smaller motor also allows a power supply to be provided which is appropriate to the desired torque level, rather than one which has additional capacity. In use, rather than supplying additional current to the windings of the motor so as to prevent any the loss of synchronisation (i.e. stalling), this is unnecessary where the actual rotor position is provided as an input to the controller.

In contrast to conventional DC-servo motor control techniques, in which a torque generated by a motor is controlled by monitoring current flowing in windings of the motor and controlling the current in order to achieve a desired level (which corresponds to a desired torque output), the control of a stepper motor to generate a predetermined torque uses positional feedback, thereby allowing the commutation of currents supplied to the motor to be controlled so as to cause the magnetic field generated by the energised windings of the motor to have an orientation which causes a predetermined torque to be generated. Current feedback may also be used so as to allow the controller to cause a desired current to flow in the motor windings. Thus, there are two parameters which can be controlled (field orientation and current magnitude) in order to achieve a directed motor output characteristic (e.g. generated torque).

It will be understood that a stepper motor controller (e.g. the TMC262 device) may provide internal current feedback (for example, by monitoring the voltage developed across the resistor 79). That is, the stepper motor controller 74 may be requested to cause a predetermined current flow in the windings by the field vector generation block 80 and the torque controller 69, and may use current feedback in a control process to modulate the control signals (e.g. PWM control signals) so as to ensure that the predetermined current level is achieved.

It will, of course, be appreciated that motors having different constructions will require different control schemes. For example, where a stepper motor having a different native resolution (i.e. degrees per step), a different field angle may be required to generate a maximum torque. Further, in some embodiments a motor may be operated with a predetermined field angle which does not correspond to a maximum torque output. That is, the field angle is not necessarily set to 90 electrical degrees. Moreover, where the motor is to be controlled in a position controlled mode, the desired field lead angle may be set to zero degrees.

In some configurations, when controlling a stepper motor in a position controlled manner, the motor torque may be varied by providing a constant current to the coils 21A, 21B and varying the field angle (i.e. by varying the control value which output by the phase angle adder 70). When controlling the motor torque in this manner, the motor current must set so as to be sufficiently large enough to be able to provide the maximum torque that may be required by the motor 21, when the field angle is at 90 degrees. When maximum torque is not required the field angle may be reduced to result in a lower torque generated by the motor. When using the stepper motor drive arrangement described above, this may provide a high control resolution with which to vary to the motor torque, since the field angle variable may, for example, provide 8-bits of control resolution (i.e. 256 separate control settings).

It will be appreciated that by providing a constant current to the coils 21A, 21B, which is sufficiently high to allow for any possible instantaneous maximum torque requirement, from Joule's first law, the power consumption, and thus the temperature, of the coils will be relatively high. Moreover, when controlled in this way, the motor 21 may be inefficient. It is advantageous to ensure that only the current necessary for the instantaneous torque demand is drawn, such that the current is not constant throughout operation of the motor 21.

Of course, more efficient use of the motor can be achieved by using current scaling and setting the torque angle to be 90 degrees at all times. However, this provides a limited degree of control resolution (e.g. 5-bits when using the stepper motor controller described above).

It has been realised, therefore, that in order to simultaneously offer increased control resolution, while also allowing efficient us of the motor, both of the current scaling and field angle values can be varied in order to generate a desired motor torque. This may be particularly beneficial when higher torques are required to be generated by the motors, for example when using wide (e.g. 107 mm wide) printheads. Of course, the same techniques can also be used when using other printheads (e.g. 53 mm wide).

It will be appreciated from FIG. 5 that the motor driver 71 may receive as inputs the output 102 of the phase angle adder 70 and the current scaling signal 101. The value of field angle control signal 100 may be used by the motor 21 to cause the field angle to have a predetermined value, and the value of the current scaling signal 101 may be used to cause the magnetic field generated by the windings of the motor 21 to have a predetermined magnitude.

Moreover, it will be appreciated that the current scaling signal 101 and the field angle control signal 100 are generated based on the target position of the printhead and the absolute position signal $P_A$, as these are both received by the position adder 65 and a position error signal is output from the position adder 65. In such a control scheme, the larger the position error, the larger the torque generation requirement of the motor 21 will be in order to move the printhead to its target position.

When the torque generation requirement is relatively low, the field angle control signal 100 may be varied, and the current scaling signal 101 may remain at a constant predetermined value in order to control the torque output of the motor. However, when the torque generation requirement is relatively high, the field angle control signal 100 may remain at a constant predetermined value (e.g. 90 degrees, electrical) and the current scaling signal 101 may be varied in order to provide a correspondingly large corrective torque. By only varying the value of the current scaling signal 101 (rather than also varying the field angle) in certain circumstances, such as when a large corrective torque is needed, the average power consumption of the motor 21 may be reduced, and the efficiency of the motor 21 may be increased.

It has been further realised that by maintaining the value of the current scaling signal 101 constant and varying the value of the field angle control signal 100 when a relatively low torque is required, a high degree of control sensitivity can be provided for low torque requirements. This can be achieved since the full range of the field angle control values can be used to vary the torque output between zero and a maximum value for the selected current level (which may be set to a relatively low overall value).

It will be appreciated that the field angle control signal 100 described herein is the control signal generated by the torque controller 69. At any instantaneous point in time, the field angle control signal 100 may have a value (e.g. in the range of 0 to 255). Further, it will also be appreciated that the current scaling signal 101 described herein is another control signal generated by the torque controller 69. At any instantaneous point in time, the current scaling signal 101 may have a value (e.g. in the range of 0 to 31). When it is referred to varying the field angle control signal 100 or the current scaling signal 101, it will be understood that the value of those signals may be varied.

Figure 8:
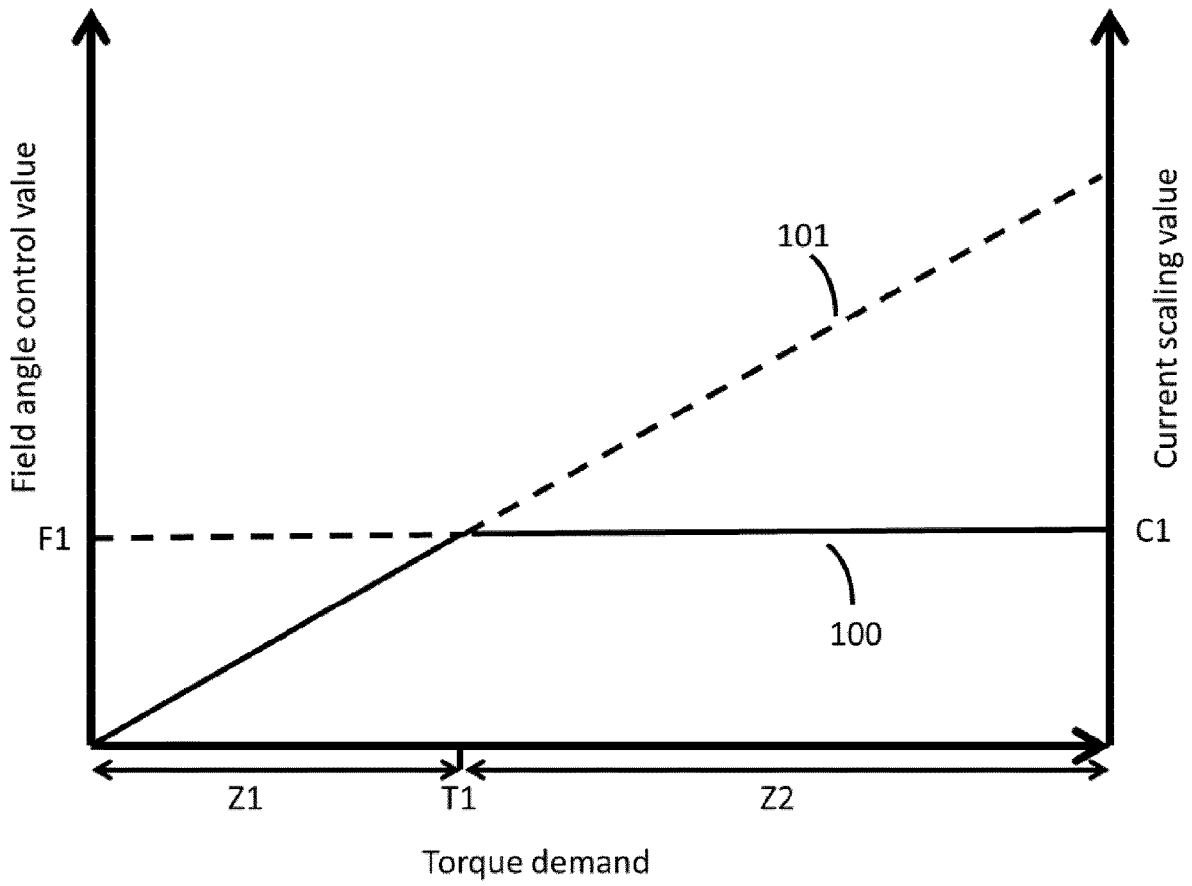
FIG. 8 is a graph showing the relationship between the demanded torque and the control signals applied to a stepper motor to provide the demanded torque by the controller of FIG. 5.

FIG. 8 illustrates how the torque controller 69 may be configured to vary the field angle control signal 100 and the current scaling signal 101 in dependence upon the position control (torque demand) signal.

A first zone Z1 may represent a scenario where the control value being received by the torque controller 69 is relatively low. When the control value being received by the torque controller 69 is relatively low, this may be considered to be a first predetermined condition. In this zone, the value of the field angle control signal 100 is increased linearly as the torque demand increases, and the current scaling signal 101 remains at a predetermined, non-zero, constant value C1.

At a transition value T1 of the torque demand value (which may also be referred to as a threshold value), the field angle control signal 100 reaches a predetermined value F1, which may, for example, be equivalent to a field angle of 90 degrees (electrical). In such an arrangement, the torque generated by the motor will be equal to the maximum value which can be generated for the constant current scaling value C1.

As the torque demand increases beyond the transition value T1, and is considered to be relatively high, the controller enters a second zone Z2. When the control value being received by the torque controller 69 is relatively high, this may be considered to be a second predetermined condition. In the second zone Z2, the field angle control signal 100 remains constant at the predetermined value F1 (e.g. the maximum value), and the current scaling signal 101 increases linearly. As described above, the value of the field angle control signal 100 may have a relatively high resolution in comparison to the resolution of the current scaling signal 101. As such, the first zone Z1 may be considered to have a resolution that is higher than that of the second zone Z2.

By way of example, the stepper motor controller 74, which receives as inputs the field angle control signal 100 and the current scaling signal 101, as described above, may be a TMC262, which is capable of receiving the field angle control value 100 at 8-bit resolution and the current scaling signal 101 at 5-bit resolution. It will be understood that the resolution of the field angle control signal 100 and the current scaling signal 101 are not limited to 8-bit and 5-bit resolution respectively, but will vary depending on the stepper motor controller 74 used. However, for ease of understanding, the field angle control signal 100 and the current scaling signal 101 in the following example will be referred to as having 8-bit and 5-bit resolution respectively.

When operating in the first zone Z1 the current scaling signal 101 may be constant and be represented by 3 ('00011') when using 5-bit resolution, and the field angle control signal 101 may increase linearly from 0 to 255 ('00000000' to '11111111') when using 8-bit resolution. The predetermined current scaling value C1 may be chosen to correspond to a predetermined magnitude of the magnetic field (although the actual magnitude of torque generated will depend on the field angle, and could vary between zero, and a maximum torque value corresponding to the predetermined magnetic field magnitude).

When operating in the second zone Z2, where a higher control value (torque demand) is required, the field angle control signal 100 may remain at the constant predetermined value F1, represented by 255 ('11111111') and the current scaling value 101, may increase linearly from its predetermined value C1, 3 ('00011') to 31 ('11111') when using 5-bit resolution. The predetermined field angle control signal value F1 may correspond to a predetermined field angle.

It will be appreciated that when operating in the first zone Z1 a relatively low current level is required, and high control resolution may be provided by the use of 8-bits. Whereas, when operating in the second zone Z2, where relatively high levels of current are required, the resolution provided may be lower than that of the first zone Z1.

By configuring the current scaling signal 101 so as to only increasing when the torque demand requires it (i.e. when it exceeds the transition value T1), greater control of the power consumption of the motor when operating in a position control mode can be provided. This may be especially beneficial where maximum torque is not required, for example when the torque demand is relatively low.

It will be understood that when operating in the first zone Z1 a relatively low current level is required, and high control resolution may be provided by the use of 8-bits. On the other hand, when operating in the second zone Z2, where relatively high levels of current are required, the resolution provided may be lower than that of the first control zone.

It will, of course, also be appreciated that the above described conversion of torque demand values to motor control signals (i.e. field angle control signal 100 and current scaling signal 101) is one possible implementation among many alternatives that could be selected.

For example, the transition value T1 between the first and second zones Z1, Z2 could be a different value. Similarly, the predetermined current scaling value C1 could be different (e.g. higher or lower). Further, the predetermined field angle control signal value F1 used in the second zone Z2 could be a value other than 90 degrees (electrical). It will, however, be understood that any departure from this value will result in a decrease in efficiency, and therefore a less optimal value. However, a small departure from this value may only have a small loss in efficiency, especially since the rate of change of torque generated for each change in field angle is relatively small at around 90 degrees (since the torque-angle characteristics is relatively flat at this point—as shown in FIG. 6).

The dependence of the field angle control signal 100 and the current scaling signal 101 upon positional control (torque demand) may be described more generally as set out in more detail below. The current scaling signal 101 may be represented by P discrete values (32 when using 5-bits). Of these P (32) values, Q values may be covered by field control. In the example described above, Q is 4 (with possible values of '0', '1', '2', and '3'), with the maximum value ('3') corresponding to the predetermined, non-zero, constant value C1 of the current scaling signal 101.

The field angle control signal 100 may be represented by M discrete values (256 when using 8-bits). As such, there will be M/Q (64) field angle control values per current scaling interval. A position control interval may be considered to correspond to a field angle control interval of 1. Consequently, there are P*(M/Q) (2048) possible positional control values (i.e. torque demand values as indicated on the x-axis in FIG. 8).

It will be appreciated that the user may wish to not use all available values P of the current scaling signal 101, such that the current scaling signal 101 may be chosen to become saturated when operating in the second zone Z2, at a value less than P (but greater than Q).

Further, it will be understood that the field angle control signal 100 will become saturated at M−1 (255 in the present example), and the current scaling signal 101 should not be set to less than Q−1 (3) in order to maximise the available resolution in the control zone Z1. It is, of course, noted that Q could be selected so as to be lower than 4 if required. However, if desired, the number of intervals of the field angle control signal 100 may be chosen to be less than M, so long as the field angle control signal 100 becomes saturated at a value of (M−1), in order to prevent a discontinuity in the torque generated.

In FIG. 8, the relationship between field angle control signal and torque demand value is shown to be a linear relationship. In an alternative embodiment, the relationship between the field angle control signal 100 and the torque demand may be non-linear when the field angle control signal 100 is below a predetermined maximum value. Similarly, the relationship between the current scaling signal 101 and the torque demand may also be non-linear when the current scaling signal 101 is above a minimum predetermined value.

In a further alternative, a third (or further) control zone may be provided in. For example, rather than a single transition value T1 in the torque demand value, a transition region may be provided in which both field angle control signal 100 and current scaling signal 101 are varied.

In another embodiment, rather than distinct control zones (e.g. Z1, Z2), a mapping may be provided by reference to a lookup table. For example, for each torque demand value, a pair of motor control signal values may be stored in a lookup table stored in a memory associated with the controller.

In general terms, it will be understood that the conversion of torque demand (as indicated by the position control signal) to motor control signals is governed by a relationship between those values, which can be selected so as to provide improved motor operation. The relationship between the position control signal and the motor control signals may comprise a first relationship between the position control signal and the field angle control signal 100, and second relationship between the position control signal and the current scaling signal 101. These relationships may be predetermined relationships which are generated during design and testing of the printer 1, and which are stored in memory associated with the controller.

While the motor controller 60 described above is described in combination with the printhead motor 21, it will be understood that a similar controller can also be used to control the carriage motor 17. In such an arrangement, the controller may be configured to receive an input that is indicative of a demanded carriage position (or carriage target position). The demanded carriage position may be provided to the controller by a carriage motion control algorithm under the control of a printer controller, which may be configured to cause the printhead carriage to follow a predetermined motion profile (e.g. during steps S14 and/or S17 of the process described with reference to FIG. 4 above).

In parts of the foregoing description, references to force and pressure have been used interchangeably. Where the surface against which the printhead presses has constant area it will be appreciated that force and pressure are directly proportional, such that pressure may in practice be defined in terms of the force applied. However, the pressure applied will depend upon the width of the printing surface 11 (i.e. the dimension extending into the plane of the paper in FIG. 2) against which the print head 13 applies pressure. The pressure—for a given torque generated by the motor 21—is greater the narrower the printing surface 11, and so is the extent of compression of the printing surface, and vice versa. The printer may provide for several mounting positions for the printhead and the ability to vary the width of the printhead or printing surface. As such, the controller 30 may additionally process information indicating the width of the printing surface 11 against which the printhead presses and use this width information to determine the required torque to be generated by the motor 21.

Various controllers have been described in the foregoing description (particularly with reference to FIGS. 1, 2, 4, 5, 6, and 8). It will be appreciated that functions attributed to those controllers can be carried out by a single controller or by separate controllers as appropriate. It will further be appreciated that each described controller can itself be provided by a single controller device or by a plurality of controller devices. Each controller device can take any suitable form, including ASICs, FPGAs, or microcontrollers which read and execute instructions stored in a memory to which the controller is connected.

While embodiments of the invention described above generally relate to thermal transfer printing, it will be appreciated that in some embodiments the techniques described herein can be applied to other forms of printing, such as, for example, direct thermal printing. In such embodiments no ink carrying ribbon is required and a printhead is energised when in direct contact with a thermally sensitive substrate (e.g. a thermally sensitised paper) so as to create a mark on the substrate.

Moreover, while embodiments of the invention described above generally relate to control of a motor or motors associated with a printhead, it will be appreciated that the above described techniques may also be applied to alternative uses of stepper motors in a field controlled manner. For example, one or both of the stepper motors 6, 7 may be controlled by varying the magnitude of current supplied to the motor windings, while maintaining the field angle at the optimal level (i.e. 90 electrical degrees) when a high torque is needed, and by varying the field angle, while maintaining the magnitude of current supplied to the motor windings at the nominal low level when fine control of the (relatively low) torque is needed, as described in detail above.

In particular, the use of an encoder associated with the output shaft of a stepper motor enables the stepper motor to be controlled in a field controlled manner so as to accurately control the position of the motors, without generating excess heat in the motor windings, thereby allowing the ribbon being transported between the takeup and supply spools 3, 5, to be controlled accurately.

In an embodiment, when operating in a continuous printing mode (i.e. where the ribbon is advanced at a substantially constant speed during printing), the motor 7 which is associated with takeup spool 5 may be controlled in a field controlled way so as to maintain ribbon tension during printing, while the motor 6 (which is associated with the supply spool 3) is operated in a position controlled way as described in detail above so as to pay out ribbon. This allows both the rate of movement and the tension of ribbon 2 to be controlled. Moreover, by controlling the takeup spool 5 in a torque controlled manner, the tension in the ribbon 2 can be accurately controlled as it passes the printhead, so as to maintain an optimal peel angle, thereby allowing ink to be peeled from the ribbon in a controlled and optimal way.

On the other hand, between printing operations, when the printhead is spaced apart from the printing surface (e.g. during carriage return), both motors 6, 7 may be controlled in a position (or speed) controlled manner as described in detail above, so as to accelerate or decelerate the ribbon 2 in a controlled manner, or to rewind ribbon from the takeup spool 5 to the supply spool 3. During such operations, it will be appreciated that maintaining a predetermined the tension in the ribbon may be less important than during printing operations.

Alternatively, when operating in a continuous printing mode (i.e. where the ribbon is advanced at a substantially constant speed during printing), the motors 6, 7 may each be controlled in a position controlled way as described in detail above, so as to transport ribbon according to a predetermined motion profile. By controlling both motors in this way, the rate of movement and the tension of ribbon 2 can be controlled accurately.

While various embodiments of the invention have been described above, it will be appreciated that modifications can be made to those embodiments without departing from the spirit and scope of the present invention. In particular, where reference has been made above to printing onto a label web, it will be appreciated that the techniques described above can be applied to printing on any substrate.

The invention claimed is:

1. A printer comprising:

a printhead configured to selectively cause a mark to be created on a substrate;

a stepper motor having an output shaft coupled to the printhead, the stepper motor being arranged to vary the position of the printhead;

a sensor configured to generate a signal indicative of an angular position of the output shaft of the stepper motor; and a controller arranged to generate control signals for the stepper motor; said control signals being at least partially based upon an output of said sensor and at least partially based upon a target position, wherein:

said control signals for the stepper motor are arranged to cause a magnetic field to be generated by windings of the stepper motor, a field angle being defined between an angular position of the output shaft of the stepper motor, and an orientation of the generated magnetic field;

said control signals comprise a first control signal configured to cause said field angle to have a predetermined value, and a second control signal configured to cause said magnetic field to have a predetermined magnitude; and said controller is configured to vary said first and second control signals based upon said target position and said output of said sensor.

2. A printer according to claim 1, wherein the first control signal is generated based upon the signal indicative of an angular position of the output shaft of the stepper motor so as to cause the field angle to have said predetermined value.

3. A printer according to claim 1, wherein said controller is configured to vary said first and second control signals based upon a position control signal, said position control signal being generated based upon said target position and said output of said sensor.

4. A printer according to claim 3, wherein said controller is configured to vary said first and second control signals based upon a predetermined relationship with position control signal.

5. A printer according to claim 4, wherein said controller is configured to vary said first control signal based upon a first predetermined relationship with said position control signal.

6. A printer according to claim 5, wherein said controller is configured to vary said first control signal according to the first predetermined relationship when said position control signal satisfies a first predetermined condition.

7. A printer according to claim 6, wherein said controller is configured to vary said first control signal according to the first predetermined relationship, and control said second control signal to have a fixed value when said position control signal satisfies the first predetermined condition.

8. A printer according to claim 7, wherein:

said controller is configured to vary said second control signal based upon a second predetermined relationship with said position control signal and control said first control signal to have a fixed value when said position control signal satisfies a second predetermined condition; and the first relationship defines a first control resolution and the second relationship defines a second control resolution, the first control resolution being higher than the second control resolution.

9. A printer according to claim 4, wherein said controller is configured to vary said second control signal based upon a second predetermined relationship with said position control signal.

10. A printer according to claim 9, wherein said controller is configured to vary said second control signal according to the second predetermined relationship when said position control signal satisfies a second predetermined condition.

11. A printer according to claim 10, wherein said controller is configured to vary said second control signal according to the second predetermined relationship and control said first control signal to have a fixed value when said position control signal satisfies the second predetermined condition.

12. A printer according to claim 3, wherein the controller comprises a position controller arranged to receive said target position and said signal indicative of an angular position of the output shaft of the stepper motor, and generate said position control signal, said position control signal being indicative of a predetermined torque to be generated by the stepper motor.

13. A printer according to claim 12, wherein the position controller is arranged to generate a position error signal based on said target position and said output of said signal indicative of an angular position of the output shaft of the stepper motor, and generate said position control signal based upon said position error signal.

14. A printer according to claim 1, wherein the controller is configured to generate said target position based on a desired printhead motion profile.

15. A printer according to claim 1, wherein the printhead is rotatable about a pivot and wherein the stepper motor is arranged to cause rotation of the printhead about the pivot to vary the position of the printhead relative to the printing surface.

16. A printer according to claim 1, further comprising a printhead drive mechanism for transporting the printhead along a track extending generally parallel to the printing surface, wherein the controller is configured to control the stepper motor to cause the printhead to maintain a position in which it is spaced apart from the printing surface by a predetermined separation during transport of the printhead along the track extending generally parallel to the printing surface between printing strokes.

17. A printer according to claim 16, wherein:

said stepper motor is a first motor, and the printhead drive mechanism comprises a second stepper motor; and the controller is configured to control said first and second motors in a coordinated manner to control the position of the printhead in directions parallel and perpendicular to the printing surface.

18. A printer according to claim 17, further comprising:

a second sensor configured to generate a signal indicative of an angular position of the output shaft of the second motor; and a controller arranged to generate second control signals for the second motor, said second control signals being at least partially based upon an output of said second sensor and at least partially based upon a second target position:

wherein:

said second control signals for the stepper motor are arranged to cause a second magnetic field to be generated by windings of the second motor, a second field angle being defined between an angular position of the output shaft of the second motor, and an orientation of the generated second magnetic field;

said second control signals comprise a first second control signal configured to cause said second field angle to have a second predetermined value, and a further second control signal configured to cause said second magnetic field to have a second predetermined magnitude; and said controller is configured to vary said first and further second control signals based upon said second target position and said output of said second sensor.

19. A printer according to claim 1, wherein the printer is a thermal printer and wherein the printhead is configured to be selectively energised so as to generate heat which causes the mark to be created on the substrate.

20. A thermal transfer printer comprising:

first and second spool supports each being configured to support a spool of ink carrying ribbon;

a ribbon drive configured to cause movement of ribbon from the first spool support to the second spool support; and a printhead configured to be selectively energised so as cause ink to be transferred from the ribbon to the substrate so as to cause a mark to be created on the substrate;

the ribbon drive comprising:

a stepper motor having an output shaft operably associated with one of said spool supports, the stepper motor being arranged to cause said one of the spool supports to rotate to cause said movement of ribbon from the first spool support to the second spool support;

a sensor configured to generate a signal indicative of an angular position of the output shaft of the stepper motor; and a controller arranged to generate control signals for the stepper motor; said control signals being at least partially based upon an output of said sensor and at least partially based upon a target position wherein:

said control signals for the stepper motor are arranged to cause a magnetic field to be generated by windings of the stepper motor, a field angle being defined between an angular position of the output shaft of the stepper motor, and an orientation of the generated magnetic field;

said control signals comprise a first control signal configured to cause said field angle to have a predetermined value, and a second control signal configured to cause said magnetic field to have a predetermined magnitude; and said controller is configured to vary said first and second control signals based upon said target position and said output of said sensor.

* * * * *